US008858114B2

(12) United States Patent
Gaspar

(10) Patent No.: US 8,858,114 B2
(45) Date of Patent: Oct. 14, 2014

(54) ADJUSTABLE SUPPORT APPARATUS FOR A UTILITY ACCESS COVER

(76) Inventor: Chris Gaspar, Chilliwack (CA)

( * ) Notice: Subject to any disclaimer, the term of this patent is extended or adjusted under 35 U.S.C. 154(b) by 228 days.

(21) Appl. No.: 13/481,504

(22) Filed: May 25, 2012

(65) Prior Publication Data

US 2013/0312338 A1 Nov. 28, 2013

(51) Int. Cl.
*E02D 29/12* (2006.01)
*E02D 29/14* (2006.01)

(52) U.S. Cl.
CPC ..... *E02D 29/12* (2013.01); *E02D 29/14* (2013.01)
USPC ..... 404/25; 404/26; 52/19

(58) Field of Classification Search
CPC ..... E02D 29/1409; E02D 29/14; E02D 29/12
USPC ..... 404/25, 26; 52/19, 20
See application file for complete search history.

(56) References Cited

U.S. PATENT DOCUMENTS

| | | | | | |
|---|---|---|---|---|---|
| 1,076,386 | A | | 10/1913 | O'Day | |
| 1,165,044 | A | | 12/1915 | Tyler | |
| 1,408,982 | A | * | 3/1922 | Calhoun | 404/26 |
| 1,447,256 | A | | 3/1923 | Lincoln | |
| 2,801,579 | A | | 8/1957 | Vinton | |
| 2,930,295 | A | | 3/1960 | Hale | |
| 3,218,942 | A | | 11/1965 | Raquet | |
| 3,263,579 | A | | 8/1966 | Dorris | |
| 3,326,100 | A | | 6/1967 | White | |
| 3,408,778 | A | | 11/1968 | Mason | |
| 3,611,889 | A | * | 10/1971 | Levinson | 404/26 |
| 3,629,981 | A | * | 12/1971 | McCaffery | 52/19 |
| 3,858,998 | A | | 1/1975 | Larsson et al. | |
| 3,930,739 | A | | 1/1976 | Larsson et al. | |
| 4,038,789 | A | | 8/1977 | Axgarde et al. | |
| 4,197,031 | A | | 4/1980 | Hild | |
| 4,255,909 | A | | 3/1981 | Soderstrom | |
| 4,273,467 | A | | 6/1981 | Cronk | |
| 4,337,005 | A | * | 6/1982 | LeBaron | 404/26 |
| 4,466,219 | A | | 8/1984 | Campolito | |
| 4,536,103 | A | | 8/1985 | Prescott | |
| 4,582,450 | A | | 4/1986 | Neil | |
| 4,666,333 | A | | 5/1987 | Armstrong | |
| 4,906,128 | A | | 3/1990 | Trudel | |
| 5,165,819 | A | | 11/1992 | Bowman | |
| 5,211,504 | A | | 5/1993 | Trudel | |
| 5,344,253 | A | | 9/1994 | Sacchetti | |
| 5,513,926 | A | | 5/1996 | Prescott | |
| 5,549,411 | A | | 8/1996 | Hawkins | |
| 5,634,739 | A | | 6/1997 | Armstrong | |
| 5,769,564 | A | | 6/1998 | Hawkins | |

(Continued)

FOREIGN PATENT DOCUMENTS

| | | |
|---|---|---|
| CA | 1320071 | 9/1989 |
| CA | 2309649 | 3/2000 |

(Continued)

*Primary Examiner* — Raymond W Addie
(74) *Attorney, Agent, or Firm* — Cameron IP

(57) ABSTRACT

A support apparatus for a frame of a utility access cover comprises an inner support member and an outer support member in telescopic engagement with the inner support member. The height and inclination of the support apparatus is adjustable by selectively positioning the first support member relative to the second support member and securing the first support member to the second support member with the fasteners.

10 Claims, 32 Drawing Sheets

(56) References Cited

U.S. PATENT DOCUMENTS

| | | | | |
|---|---|---|---|---|
| 5,785,409 | A * | 7/1998 | Reinert, Sr. | 362/153.1 |
| 5,934,820 | A | 8/1999 | Hinkle | |
| 5,993,106 | A | 11/1999 | Huang | |
| 6,161,985 | A | 12/2000 | Hinkle et al. | |
| 6,179,518 | B1 | 1/2001 | Suatac | |
| 6,371,687 | B1 | 4/2002 | Heintz et al. | |
| 6,371,688 | B1 | 4/2002 | Yang et al. | |
| 6,520,713 | B2 | 2/2003 | Sondrup | |
| 6,524,026 | B2 | 2/2003 | Sondrup | |
| 6,685,333 | B1 * | 2/2004 | Bieberdorf | 362/153.1 |
| 6,698,973 | B2 | 3/2004 | Suatac | |
| 6,769,834 | B1 | 8/2004 | Stange | |
| 6,811,350 | B2 | 11/2004 | Nadasde | |
| 6,953,302 | B1 | 10/2005 | Kochling | |
| 6,997,639 | B2 | 2/2006 | Nadasde | |
| 7,080,954 | B2 * | 7/2006 | Monneret et al. | 404/25 |
| 8,540,454 | B2 * | 9/2013 | Lee | 404/26 |
| 2003/0206770 | A1 | 11/2003 | Schrage | |
| 2004/0013466 | A1 | 1/2004 | Sondrup | |
| 2004/0071508 | A1 | 4/2004 | Nadasde | |
| 2004/0109727 | A1 | 6/2004 | Konno | |
| 2004/0120762 | A1 | 6/2004 | Sondrup | |
| 2007/0031190 | A1 | 2/2007 | Meyers | |

FOREIGN PATENT DOCUMENTS

| | | |
|---|---|---|
| JP | 7158095 | 6/1995 |
| JP | 8027821 | 1/1996 |
| JP | 10121501 | 5/1998 |
| KR | 20040012148 | 2/2004 |

* cited by examiner

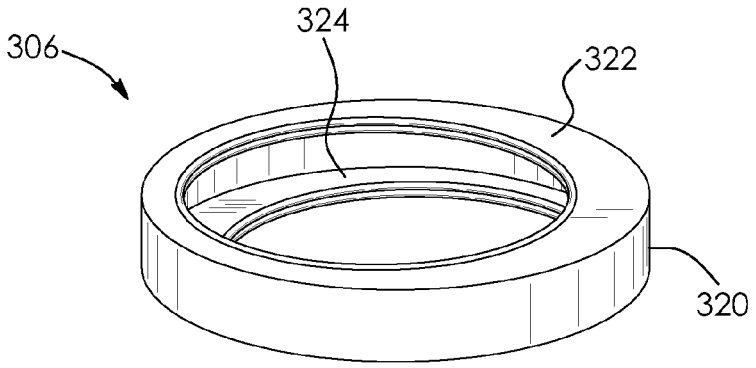
FIG. 22
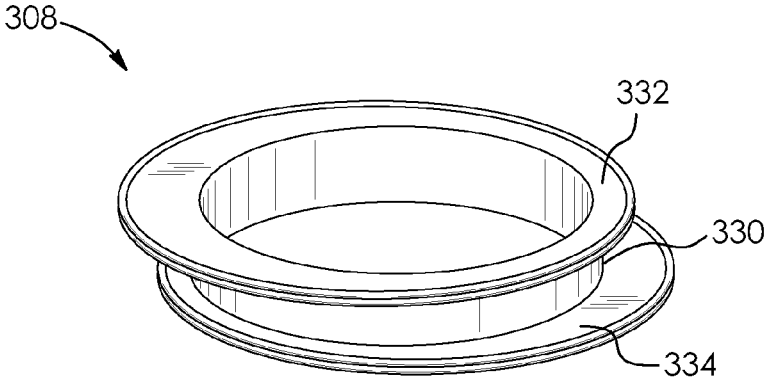
FIG. 23
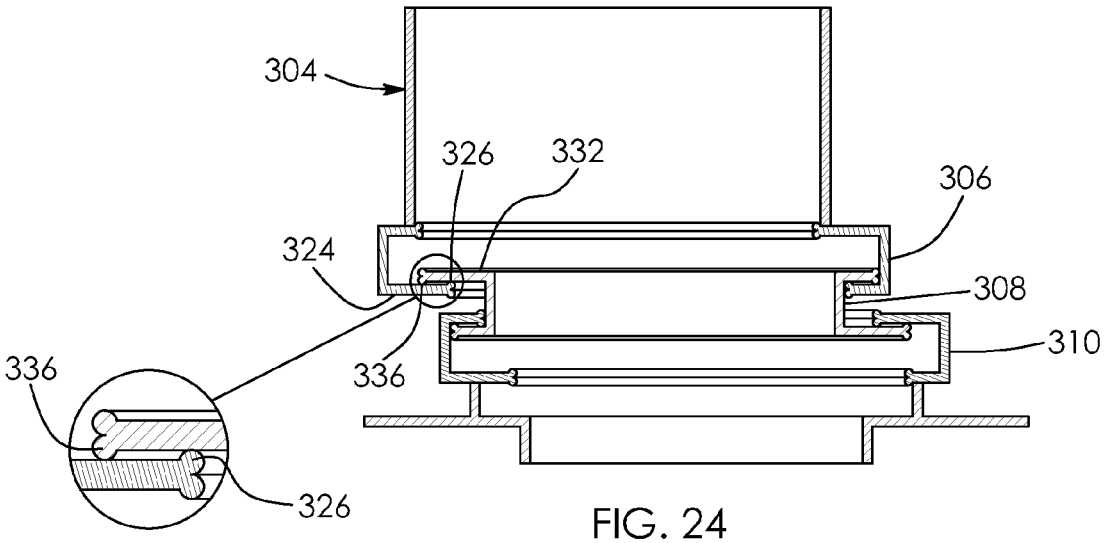
FIG. 24
FIG. 25

ADJUSTABLE SUPPORT APPARATUS FOR A UTILITY ACCESS COVER

BACKGROUND OF THE INVENTION

1. Field of the Invention

The present invention relates to a support apparatus for a utility access cover and, in particular, to a support apparatus for adjusting the elevation and gradient of a utility access opening.

2. Description of the Related Art

It is known to use either a brick or concrete riser ring structure to adjust the height and inclination of a utility access opening. This is a difficult and time consuming process when the utility access opening must be set substantially coplanar with an existing or proposed surrounding surface. When done conventionally it is necessary preferable to mortar all horizontal and vertical joint surfaces and ensure that there are no voids in the mortar. However, often foreign objects such as small rocks or pieces of wood are instead used as wedges to set the elevation and gradient of the access opening. Mortar is then simply applied to the interior and exterior side walls of the brick or concrete riser ring structure. This leaves voids in the brick or concrete riser ring structure and compromises the integrity of the structure.

It is also known to use a prefabricated support structure to adjust the height and inclination of a utility access opening. The height and inclination of the utility access opening is adjusted by setting the base of the support structure to a desired elevation and gradient. Since all adjustments are made at the base of the support structure it can be difficult to achieve the height and inclination required so the utility access opening is substantially coplanar with an existing or proposed surrounding surface. It is often necessary to remove backfill to reset the base of the support structure which is both costly and time consuming. To overcome the aforementioned difficulties numerous adjustable support structures have been developed for adjusting the height and inclination of a utility access opening.

U.S. Pat. No. 4,038,789 issued on Aug. 2, 1977 to Axegärde et al., and the full disclosure of which is incorporated herein by reference, discloses an adjustable manhole assembly comprising a top frame for carrying a cover and a bottom frame supported on a base for the manhole. A portion of the top frame is telescoped in the bottom frame. There is a plurality of lock means for locking the frames in a mutually-adjusted position. The lock means extend between the portion of the top frame inserted in the bottom frame and include laterally projecting screws terminating outside of the portion telescoped in the bottom frame. The bottom frame includes counterpressure surfaces confrontingly disposed adjacent the ends of the screws for engagement therewith when the screws are tightened. The counterpressure surfaces extend at a vertical angle with respect to the vertical axis of the bottom frame and converge downwardly. The protruding screws have a plurality of adjusted positions along the angular counterpressure surface to position the frames at different adjusted levels. The longitudinal axes of said screws are substantially perpendicular to a corresponding counterpressure surface with which it cooperates, and the end portions of the screws move substantially parallel against the counterpressure surface when the screws are tightened.

U.S. Pat. No. 5,165,819 issued on Nov. 4, 1992 to Bowman, and full disclosure of which is incorporated herein by reference, discloses a manhole cover support which may be held level or at an incline while still permitting the efficient establishment of a new cover height elevation and adjustment of the same. The cover support is adaptable to standardize on the manhole cover size and inventory of covers for a group of manhole installations having geometrically similar but somewhat varying sizes. The cover support comprises a top peripheral flange having a seat for a manhole cover and a cover keeper that rises from the outer periphery of the seat. There is a base fitting into the confines of the cover keeper of an existing manhole cover-receiving structure such as a manhole frame. The base supports the flange and is in a slidable engagement with the flange.

U.S. Pat. No. 5,513,926 issued on May 7, 1996 to Prescott, and the full disclosure of which is incorporated herein by reference, discloses an adjustable manhole head assembly for mounting a cover onto a manhole frame. The assembly has a lower annular rim member and an upper annular rim member. The lower member has a bottom side which is sized and shaped to rest on the manhole frame. The lower member also has an opposite top side with an inner surface portion which is sized and shaped to receive and support the peripheral bottom portion of the cover. The opposite top side of the lower member also has an outer surface portion. The upper annular rim member has a bottom side sized and shaped to rest onto the outer surface portion of the top side of the lower rim member in order to fully surround the peripheral edge of the cover when the upper annular rim member lays on the inner surface portion of the top side of the lower rim member. The upper annular rim member also has an opposite top side and a thickness substantially equal to one of the peripheral sidewalls of the cover. Bolts are used for anchoring to the manhole frame together with the upper and lower rim members in an operative position to receive and support the cover. The manhole head assembly can be vertically adjusted with one or more intermediate rim members to conform to new surrounding surface levels.

U.S. Pat. No. 5,934,820 issued on Aug. 10, 1999 to Hinkle, and the full disclosure of which is incorporated herein by reference, discloses a system and method for raising a manhole ring during construction of roads. The system includes a generally tubular form for placing on a manhole cone in an excavation, and a trimming/cutting tool for adjusting the height of the form. The cutting tool is preferably positioned inside the form and is rotated around to cut a ring of material off of the top of the form. The cutting tool is set at a desired elevation, indexed off of the pavement around the excavation, which results in the form being cut to a height that can support a manhole ring at a proper elevation to be flush with the pavement surface of a particular site. A single pour of concrete may be done to create a concrete collar that fills and seals the vertical space between the manhole cone and ring. The form may include a stabilizing system for holding the form in place on the manhole cone.

U.S. Pat. No. 6,524,026 issued on Feb. 25, 2003 to Sondrup, and the full disclosure of which is incorporated herein, discloses a height adjustable utility access device, such as a manhole, which adjusts in height to allow a top of a cover to sit flush with the surrounding surface, such as a road. The device has a cover which covers access to the utility; a frame coupled over the utility; and an adjuster, coupled between the cover and the frame, for adjusting the height of the cover relative to the frame. The adjuster can include an adaptor ring on the frame and an extension ring on the adaptor ring. The extension ring can have tabs which selectively engage a plurality of steps on the adaptor ring. Alternatively, the steps can be formed directly in the frame. Alternatively, first and second rings can be disposed between the frame and cover. The rings can have meshing steps.

U.S. Pat. Nos. 6,811,350 and 6,997,639 issued respectively on Nov. 2, 2004 and Feb. 16, 2006 to Nadasde, and the full disclosures of which are incorporated herein by reference, disclose an apparatus for adjusting the height and inclination of roadway and greenway appurtenances. The apparatus includes a rigid annular support ring mountable onto a rigid annular spacer ring sized so as to be mountable onto a manhole and a manhole frame mountable onto the support ring. The manhole frame is substantially frustoconically shaped. A rigid annular base flange may be mounted around a base end of the manhole frame. A plurality of threaded bores are formed in spaced array around the base flange. Rigid elongate threaded members are threadably mountable into the threaded bores so as to be selectively threadably adjustable in the threaded bores and so as to protrude downwardly from the base flange into engagement, beneath the manhole frame, with a top surface of the support ring when the manhole frame is mounted on the support ring. The threaded members are threadably adjustable in the threaded bores to elevate or to tilt the manhole frame relative to the support ring.

However, despite the above mentioned disclosures, there remains a need for an improved adjustable support structure for a utility access cover that may be used to adjust the height and inclination of a utility access opening.

SUMMARY OF THE INVENTION

It is an object of the present invention to provide an improved support apparatus for a utility access cover.

It is another object of the present invention to provide an improved support apparatus for a utility access cover that may be used to adjust the height and inclination of a utility access opening.

There is accordingly provided a support apparatus for a frame of a utility access cover. The support apparatus comprises a first support member and a second support member in telescopic engagement with the first support member. The first support member has a peripheral side wall with a plurality of opening extending therethrough. The second support member has a peripheral side wall with a plurality of openings extending therethrough. At least two of the openings in the side wall of the first support member are aligned with a corresponding one of the openings in the side wall of the second support member. A fastener extends through respective corresponding openings in the side wall of the first support member and the side wall of the second support member. The height and inclination of the support apparatus is adjustable by selectively positioning the first support member relative to the second support member and securing the first support member to the second support member with the fasteners. The first support member may be formed from metal and the second support member may be formed from plastic.

The support apparatus may alternatively comprise a first support member and a second support member in telescopic engagement with the first support member, wherein the first support member has a peripheral side wall and the second support member has a peripheral side wall with a plurality of channels extending axially thereon. An insert is received by a corresponding one of the channels in the side wall of the second support member and the first support member sitting on the inserts. The height and inclination of the support apparatus is adjustable by selectively positioning the inserts in the channels on the side wall of the second support member. The support apparatus as may further include a plurality of spaced-apart protrusions on the side wall of the first support member. Each of the protrusions on the side wall of the first support member may be received by a corresponding one of the channels on the side wall of the second support member.

The support apparatus may include a spacer in at least one of the channels in the side wall of the second support member. The spacer may be disposed between one of the inserts received by said at least one of the channels in the side wall of the second support member and one of the protrusions on the side wall of the first support member received by said one of the channels in the side wall of the second support member. The support apparatus may include a plurality of fasteners. Each of the fasteners may maintain a corresponding one of the inserts in position in a respective one of the channels in the side wall of the second support member. The support apparatus may include an opening in each of the channels in the side wall of the second support member and an opening in each of the inserts. Each of the fasteners may extend through respective corresponding openings in the channels in the side wall of the second support member and the inserts. The support apparatus may include a plurality of spaced-apart openings in the side wall of the first support member. Each of the fasteners further may extend through a respective one of the spaced-apart openings in the side wall of the first support member.

There is also provided a kit for constructing a support apparatus for a frame of a utility access cover. The kit apparatus comprises a first support member having a peripheral side wall and a second support member having a peripheral side wall. There is a fastener for securing the first support member to the second support member, wherein the first support member and second support member are in telescopically engageable and the height and inclination of the support apparatus is adjustable by selectively positioning the first support member relative to the second support member prior to securing the first support member to the second support member with the fastener. The first support member may be formed from plastic and includes a rigid contact area on the peripheral wall thereof for the fastener to engage. The second support member may be formed from plastic and include etching which is broken away to receive the fastener. The kit may further include a plurality of inserts which may be secured to the peripheral wall There is further provided a method of adjusting a height and inclination of a support apparatus for a frame of a utility access cover, the method comprising:

positioning a support member of the support apparatus about an access opening;

cutting the support member of the support apparatus to a desired height;

engaging another support member of the support apparatus with the cut support member of the support apparatus;

selectively positioning said another support member relative to the support member; and securing the said another support member to the support member.

BRIEF DESCRIPTIONS OF DRAWINGS

The invention will be more readily understood from the following description of the embodiments thereof given, by way of example only, with reference to the accompanying drawings, in which:

FIG. 4 is a further enlarged, fragmentary view showing the outer guard of FIG. 3 together with a transition ring;

FIG. 22 is an perspective view showing a first segment of the segmented female support member of FIG. 21;

FIG. 23 is an perspective view showing a second segment of the segmented female support member of FIG. 21; and FIG. 24 is a sectional view of the segmented female form of FIG. 21;

FIG. 25 is an enlarged view of the catches of the segmented female form of FIG. 24;

DESCRIPTIONS OF THE PREFERRED EMBODIMENTS

Figure 1:
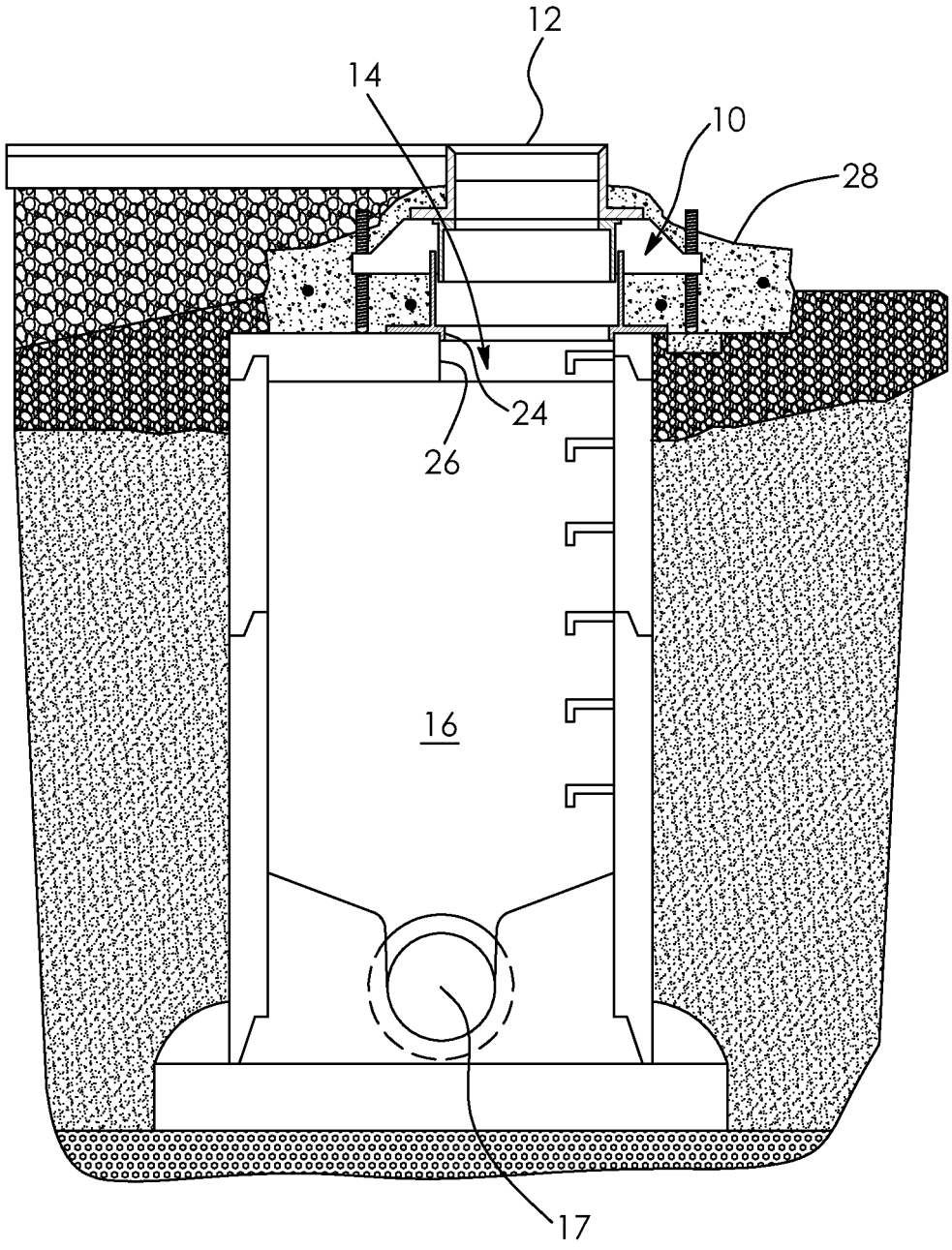
FIG. 1 is an elevation, sectional view showing an improved support apparatus which allows the height and/or inclination of an access cover to be adjusted.
Figure 2:
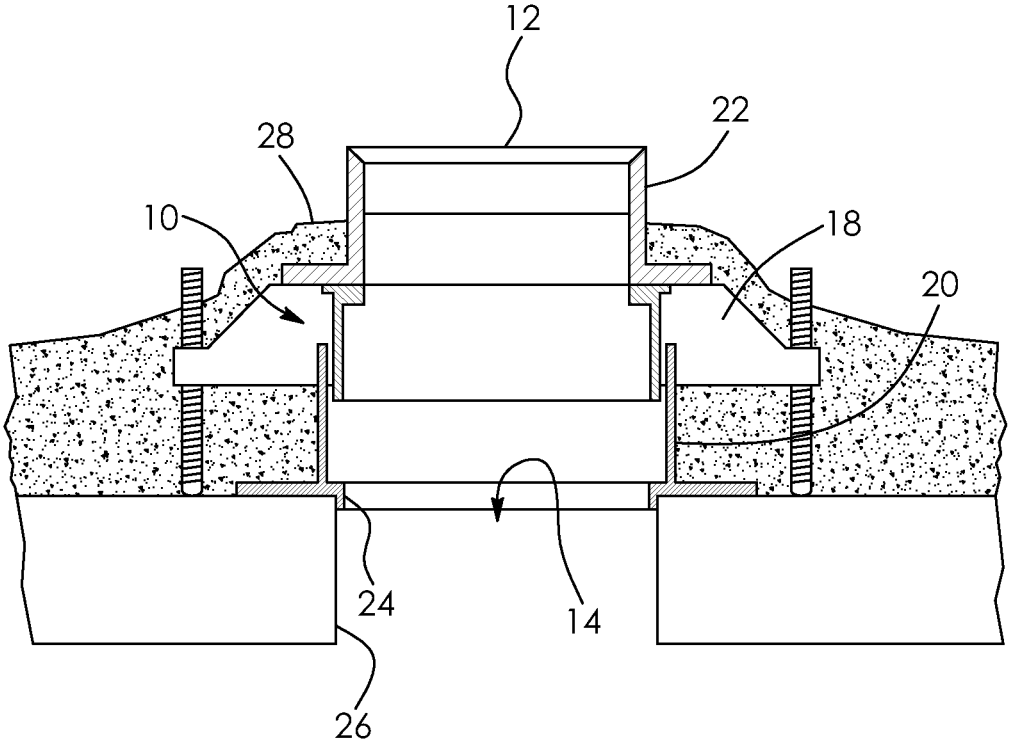
FIG. 2 is an enlarged, elevation and sectional view showing the support apparatus of FIG. 1.

Referring to the drawings and first to FIG. 1, this shows an improved support apparatus 10 for an access cover 12. The support apparatus 10 is configured to sit on an existing opening 14 of a utility 16, and the support apparatus functions to change the elevation and gradient of the opening 14. In FIG. 1 the utility 16 is a manhole which gives access to a sewer pipe 17, but the support apparatus 10 may be used with other utilities such as service boxes, catch basins, subterranean vaults, etc. As shown in FIG. 2, the support apparatus 10 includes a first support member which is a male support member 18 and a second support member which is a female support member 20. The male support member 18 supports a frame 22 for the access cover 12. The female support member 20 is provided with a lip 24 which extends into the opening 14. The lip 24 abuts an inner wall 26 of the opening 14 and restricts relative horizontal movement of the female support member 20 when the female support member is set in position over the opening 14. When in use the male support member 18 and female support member 20 of the support apparatus 10 are substantially encased in a monolithic poured-in-place retaining structure 28 formed from concrete or another suitable congealing material, e.g. asphalt cement, epoxy, etc.

Figure 3:
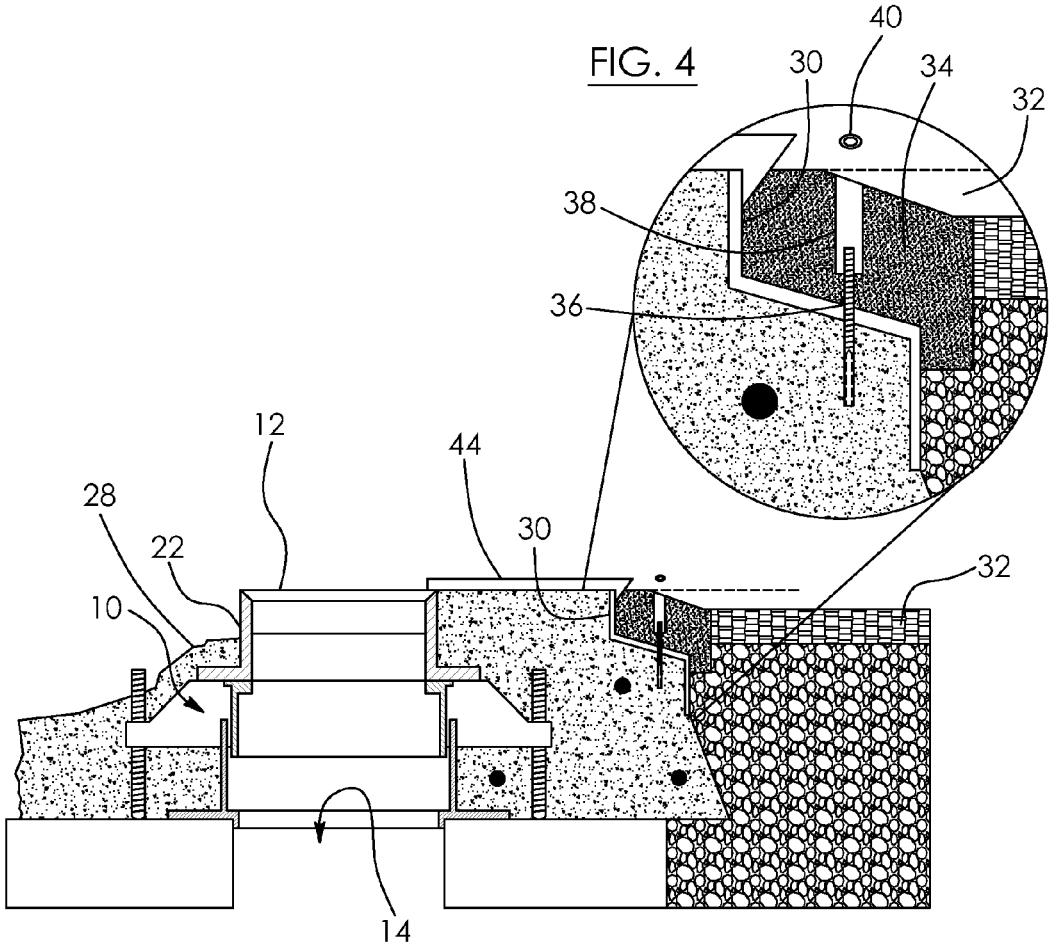
FIG. 3 is an enlarged, elevation and sectional view showing the support apparatus of FIG. 1 together with an outer guard.

The retaining structure 28 may vary in shape, size and material depending on the type of utility and anticipated overhead traffic. Additives may also be utilized. In the example of FIG. 2, the retaining structure 28 is a monolithic pour of congealing material poured around the support apparatus 10 and frame 22. In the example of FIG. 3, the retaining structure 28 is a monolithic pour of congealing material between the support apparatus 10 and an optional outer guard 30. Alternatively, in other examples, the retaining structure 28 may be a monolithic pour of congealing material between the support apparatus 10 and backfill. The monolithic pour of congealing material creates a coalescent unit, comprising the support apparatus 10, the frame 22, and the retaining structure 28, which is durable to heavy overhead traffic and environmental elements. The monolithic pour also functions to evenly disperse loads. A sealant may be used along points of connection between the access opening 14 and the support apparatus 10 as well as between the support apparatus 10 and the frame 12 to create a water resistant barrier before the monolithic pour.

The outer guard 30, shown in FIG. 3, may be used to provide a keyed transition between the retaining structure 28 and other ground materials 32, i.e. asphalt. Examples of other ground materials include top soil for greenway surfaces. The outer guard 30 is circumambient to the support apparatus 10 and allows for a clean manufactured edge between the retaining structure 28 and the ground materials 32, i.e. asphalt or top soil. The outer guard 30 may also be used to minimize the exposed area of the retaining structure 28. This is particularly desirable when the support apparatus 10 is used on greenway surfaces. The outer guard 30 may further be used to reduce the chance of differential settlement resulting from poor ground conditions or compaction around the support apparatus 10. This is particularly useful when the support apparatus has a large area and large loads are being dispersed. When the outer guard 30 is placed below the ground materials 32, this may further reduce the effects of differential settlement and, if there is differential settlement, it will not be a defined separation. However, the larger the retaining structure 28 the greater the loads are dispersed. The outer guard 30 may therefore not be required to reduce differential settlement but will still retain its functionality to allow a clean manufactured edge between the retaining structure 28 and the ground materials 32.

The outer guard 30 may still further be used as a mounting for a temporary transition ring 34, shown in FIG. 4, which allows a smooth transition between two elevations in situations where the setting or pouring of a final running surface of other ground materials 32 will be delayed. The transition ring 34 may be secured to the outer guard 30 by mounting the transition ring 34 on an anchor rod 36 which projects from the retaining structure 28 and extends through apertures in the outer guard and transition ring. In this example, the rod 36 is a threaded rod which extends into a hollow 38 of the transition ring 34. A nut 40 may be threaded onto the rod 36 in the hollow 38 to restrict relative vertical movement of the transition ring 34. The transition ring 34 may be formed out of high density polyethylene.

Figure 5:
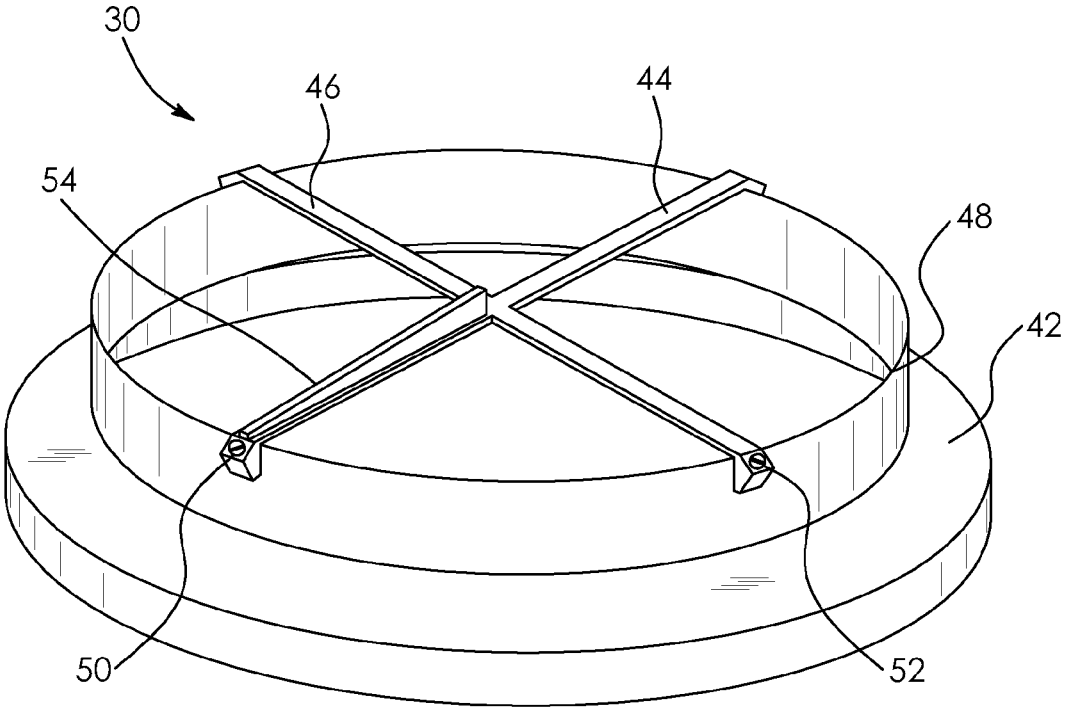
FIG. 5 is a perspective view showing the outer guard of FIG. 4.

The outer guard 30 is shown in greater detail in FIG. 5. The outer guard 30 includes a tapered step 42 and gradient alignment brackets 44 and 46. In this example, the brackets 44 and 46 form a cruciform structure extending over an opening the guard. The gradient alignment brackets are attached to a wall 48 of the outer guard 30 by set screws, for example, respective set screws 50 and 52. The alignment brackets 44 and 46 are for securing the outer guard 30 to the frame 22 for the access cover 12. This is shown in FIG. 3 for one of the alignment brackets 44. The alignment brackets 44 and 46 may be secured to the frame 22 by clamping to the frame 22. An underside of the brackets 44 and 46 will then be substantially coplanar with the frame 22 and a desired elevation and gradient will be imposed on the outer guard 30. Referring back to FIG. 5, for larger structures, the alignment brackets may be provided with stiffening ribs 54 as shown for one of the alignment brackets 44. The gradient alignment brackets 44 and 46 may be easily released from the frame 22 and the outer guard 30 by unscrewing screws 50 and 52. This allows for final trowelling and finishing of the surrounding surfaces. In this example, the outer guard 30 is annular but the outer guard may be of any geometric shape.

Figure 6:
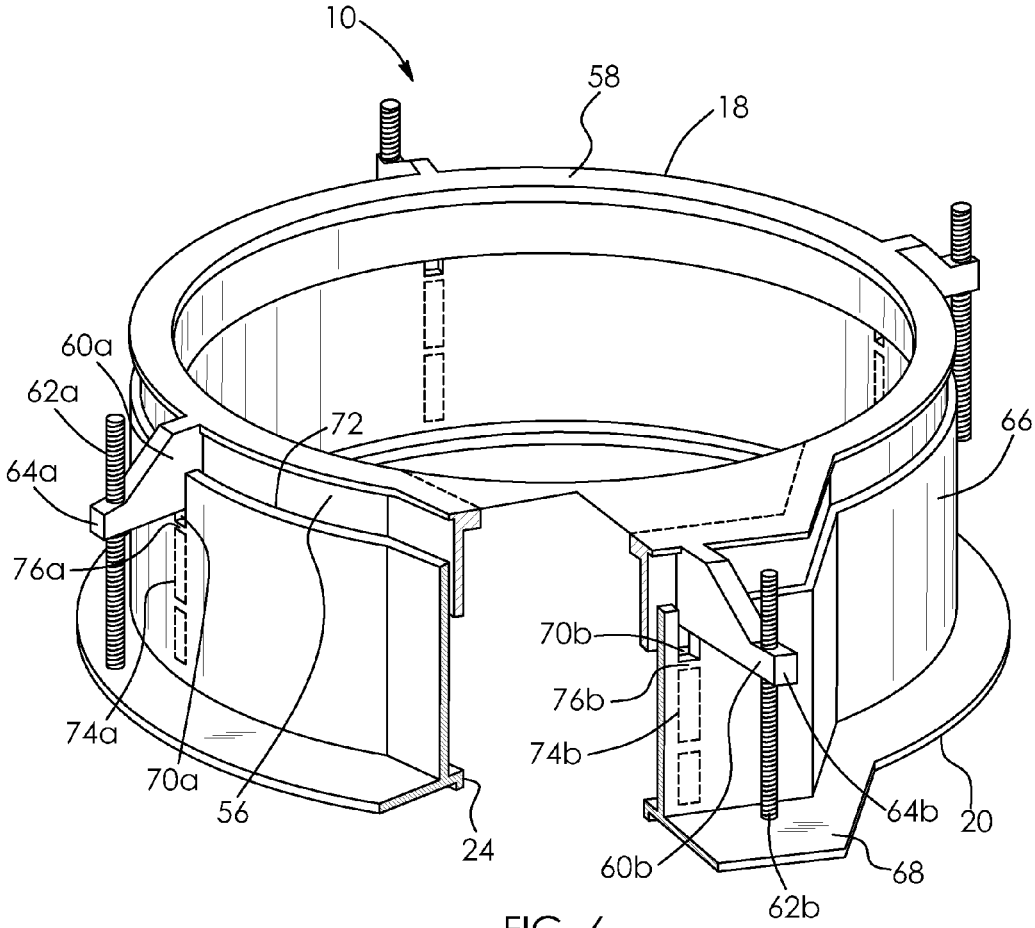
FIG. 6 is perspective view showing the support apparatus of FIG. 1.

Referring now to FIG. 6, the male support member 18 and female support member 20 are shown in greater detail. The male support member 18 has a peripheral side wall 56 and a shoulder flange 58 extending along a top edge of the side wall 56. There is a plurality of spaced-apart struts, for example struts 60*a* and 60*b*, extending radially outward from the side wall 56. Corresponding threaded set screws 62*a* and 62*b* extend threadedly through threaded apertures in each of the struts 60*a* and 60*b*. In this example the set screws 62*a* and 62*b* extend through distal ends 64*a* and 64*b*, respectively, of the struts 62*a* and 62*b*. The male support member 18 may be formed from a variety of materials but is preferably formed from a plastic polymer which may assist in preventing hydrogen sulphide from corroding the retaining structure 28 (shown in FIG. 2) when the male support member 18 is used as part of an access to a sanitary sewer. The male support member 18 is annular in this example but may be of any suitable geometric shape.

The female support member 20 has also a peripheral side wall 66 and a base flange 68 from which the lip 24, which was previously shown in FIG. 1, extends. In this example, the lip 24 extends along the entire perimeter of the base flange 68. However, in other examples, a plurality of spaced-apart lips may be provided. There is a plurality of primary slots, for example primary slots 70*a* and 70*b*, extending towards the base flange 68 from a free edge 72 of the side wall 66 of the female support member 20. There is also a plurality of secondary knockout slots, for example, secondary knockout slots 74*a* and 74*b* formed in the side wall 66 of the female support member 20. The knockout slots 74*a* and 74*b* are defined by lines of weakness as shown in stippled lines. Each of the secondary knockout slots 74*a* and 74*b* is aligned with and disposed adjacent to a corresponding one of the primary slots 70*a* and 70*b*. Each of the secondary knockout slots is also disposed between a corresponding primary slot 70*a* and 70*b* and the base flange 68. There is a sacrificial break point 76*a* between primary slot 70*a* and secondary knockout slot 74*a*. Likewise there is also a sacrificial break point 76*b* between primary slot 70*b* and secondary knockout slot 74*b*. The female support member 20 may be formed from a variety of materials but is preferably formed from a plastic polymer to allow for malleability and trimming as required. Furthermore, when used as part of an access to a sanitary sewer, the plastic polymer may assist in preventing hydrogen sulphide from corroding the retaining structure 28 shown in FIG. 1. The female support member 20 is annular in this example but may be of any suitable geometric shape.

When the support apparatus is in use, and as best shown in FIG. 1, the lip 24 of the female support member 20 extends into the access opening 14 and abuts an inner wall 26 of the opening 14. This restricts relative lateral movement of the female support member 20 after the female support member is set into position over the opening 14. Referring back to FIG. 6, the primary slots 70*a* and 70*b* of the female support member 20 receive corresponding struts 60*a* and 60*b*, respectively, of the male support member 18. Simultaneously there is telescopic engagement of the side walls 56 and 66 of the male support member 18 and female support member 20. If a lower profile is required for the support apparatus 10 the etching of the secondary knockout slots 74*a* and 74*b* of the female support structure 20 may be knocked and the sacrificial break points 76*a* and 76*b* broken away to allow, thereby allowing the secondary knockout slots 74*a* and 74*b* to receive corresponding struts 60*a* and 60*b*, respectively, of the male support member 18. Alternatively, for steep slopes, secondary knockout slots 74*a* and 74*b* and the sacrificial break points 76*a* and 76*b* may be selectively knocked out and broken away to allow the male support member 18 to engage the female support 20 structure in an inclined manner. Once the male support member 18 and female support structure 20 are mated and gradient and elevation are set, machine screws (not shown) may be used to secure the female support member 20 to the male support member 18.

The above described mating of the male support structure 18 and female support structure 20 prevents relative rotation of the male and female support structures since the struts are confined to the slots. It also moves the utility access opening to a new desired elevation. The set screws 62*a* and 62*b* may then be used to adjust the gradient of the utility access opening as is well known in the art and generally described in U.S. Pat. Nos. 6,811,350 and 6,997,639 which were previously incorporated herein by reference. However, the support structure 10 disclosed herein further provides lateral support to the set screws 62*a* and 62*b* because relative rotation of the male support member 18 and female support member 20 is prevented by the engagement of the struts 60*a* and 60*b* of the male support member with the slots 70*a* and 70*b* and possibly 74*a* and 74*b* of the female support member. Once the elevation and gradient are set the support apparatus 10 may be encased in the retaining structure 28 as described above and shown in FIGS. 1 to 3. The male support structure 18 and struts 60*a* and 60*b* thereof provide the female formwork with the rigidity required to maintain its shape until the poured retaining structure 28 solidifies. A sealant may be used along the points of connection between the male support member 18 and the female support member 20 to create a water resistant barrier before the retaining structure 28 is poured.

Figure 7:
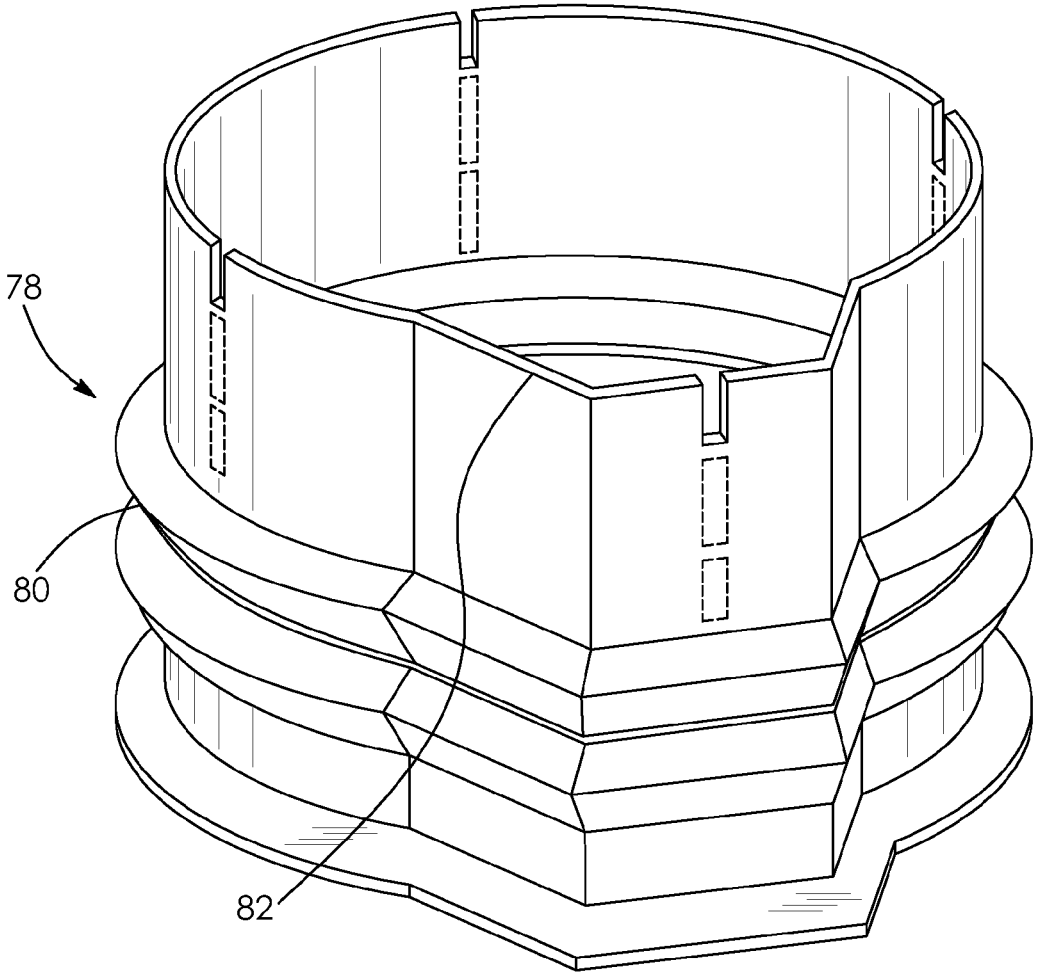
FIG. 7 is a perspective view showing a second embodiment of a female support member of the support apparatus of FIG. 1.

Referring now to FIG. 7, a second embodiment of a female support member 78 is shown. The second embodiment of the female support 78 is generally similar to the female support member 20 shown in FIG. 6. However, the second embodiment of the female support member 78 is further provided bellows 80 extending about the female support member. The bellows 80 assist in the adjustment of height and inclination. In particular, the bellows 80 allow for minor vertical adjustments of the female support member 78 without the need to trim a top 82 of the female support member. The bellows 80 may also augment the inclinating of the support apparatus by allowing the female support member 78 to be inclined. This is accomplished by offsetting opposite set screws, thereby applying a greater downward force to one side of the female support member 78 This causes the bellows 80 on said one side of the female support member 78 to compress while remaining extended on the opposite side of the female support member 78.

Figure 8:
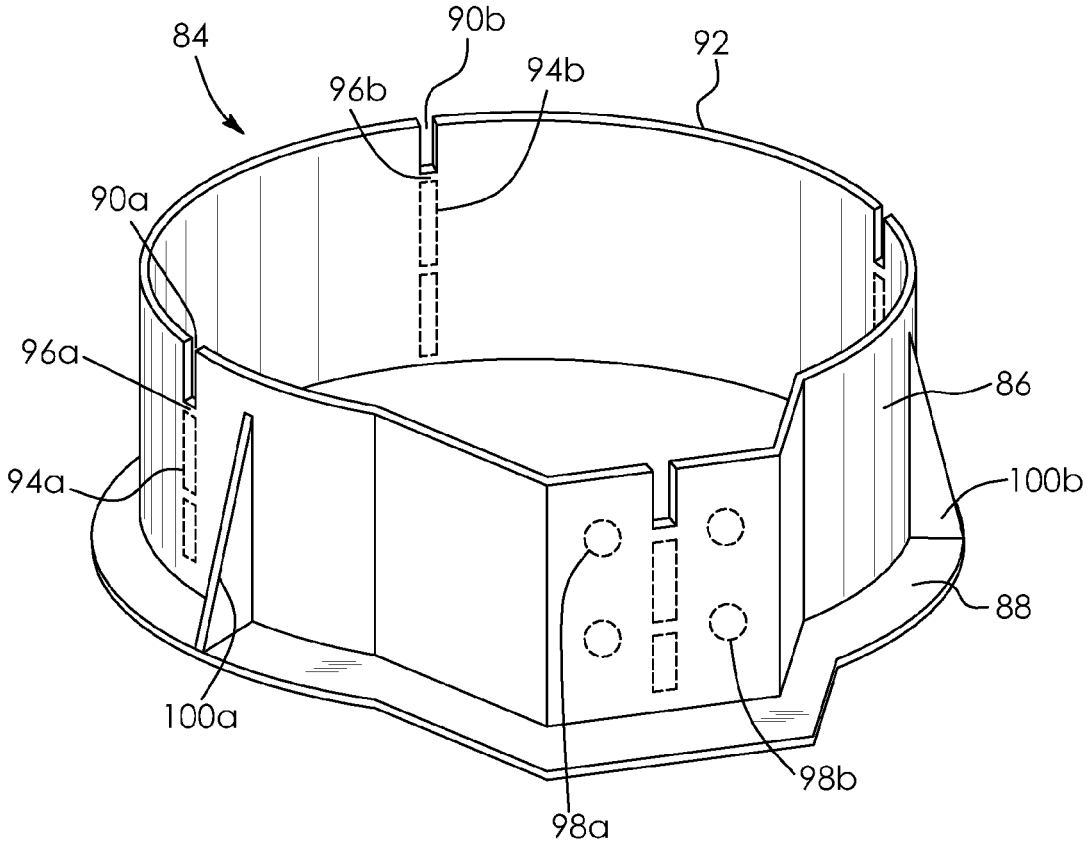
FIG. 8 is a perspective view showing a third embodiment of a female support member of the improved support apparatus of FIG. 1.

Referring now to FIG. 8, a third embodiment of a female support member 84 is shown. The third embodiment of the female support member 84 includes a peripheral side wall 86 and a base flange 88. There is a plurality of primary slots, for example, primary slots 90*a* and 90*b* extend towards the base flange 88 from a free edge 92 of the side wall 86 of the female support member 84. There is also a plurality of knockout slots, for example, knock out slots 94*a* and 94*b* etched into the side wall 86 of the female support member 84. The knockout slots 94*a* and 94*b* are defined by lines of weakness as shown in stippled lines. Each of the knockout slots 94*a* and 94*b* is aligned with and disposed adjacent to a corresponding one of the primary slots 90*a* and 90*b* between said corresponding primary slot 90*a* and 90*b* and the base flange 88. There is a sacrificial break point 96*a* between primary slot 90*a* and knockout slot 94*a*. Likewise there is also a sacrificial break point 96*b* between primary slot 90*b* and knockout slot 94*b*. The knockout slots and sacrificial break points maintain rigidity of the female support member 84 while still allow for varying engagement with a male support member (not shown in FIG. 8).

The third embodiment of the female support member 84 further includes a plurality of knockout apertures, for example, knockout apertures 98*a* and 98*b* etched into the side wall of the female support member 84. The knockout apertures 98*a* and 98*b* allow for the insertion of ladder rungs or any other attachments for incorporation into the retaining structure 28 which is shown in FIGS. 1 to 3. Alternatively, the knockout apertures may receive convection pipes to alleviate the effect of frost heave as disclosed in PCT Publication Number WO2000/017457 published in the name Svec on Mar. 30, 2000 and the full disclosure of which is incorporated herein by reference. Referring back to FIG. 8, the third embodiment of the female support member 84 still further includes a plurality of spaced-apart stiffening ribs, for example stiffening ribs 100*a* and 100*b*, extending radially outward of the side wall 86. The stiffening ribs 100*a* and 100*b* allow the female support member 84 to have an increased vertical height and provide the female support member 84 with rigidity to resist pressure from the monolithic poured-in-place retaining structure (similar to the retaining structure 28 shown in FIG. 2) prior to the retaining structure solidifying.

Figure 9:
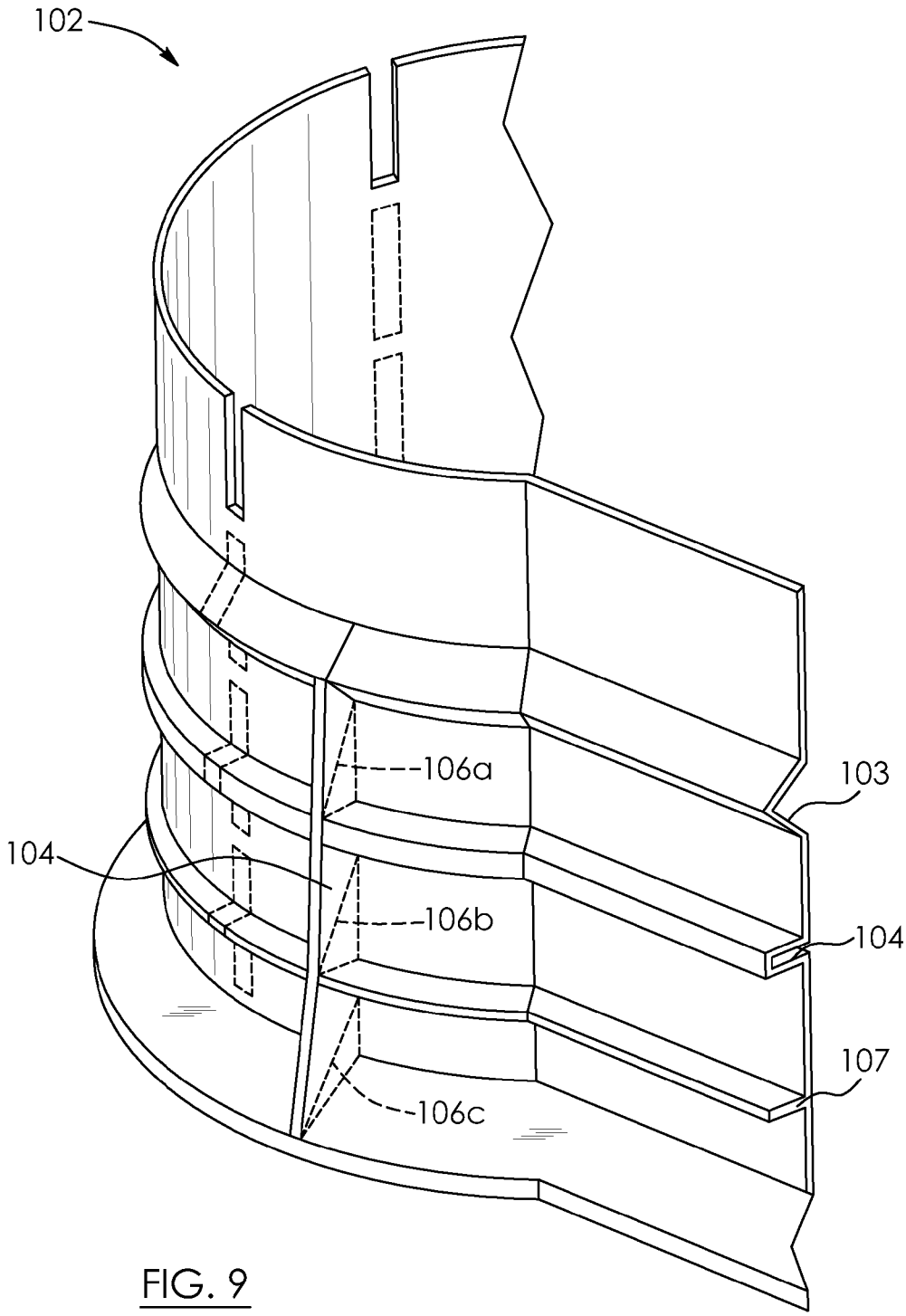
FIG. 9 is a fragmentary, perspective view showing a fourth embodiment of a female support member of the improved support apparatus of FIG. 1.

FIG. 9 shows a fourth embodiment of a female support 102 in which a stiffening rib 104 is provided with a plurality of lines of weakness 106*a*, 106*b* and 106*c* to facilitate trimming of the female support member 102. The fourth embodiment of the female support 102 is also provided with three different types of stiffening ribs 103, 105 and 107. A first one of the stiffening ribs 103 has a generally triangular cross section. A second one of the stiffening ribs 105 has a generally quadrilateral cross section. A third one of the stiffening ribs 107 is the in the form of a laterally extending flange.

Figure 10:
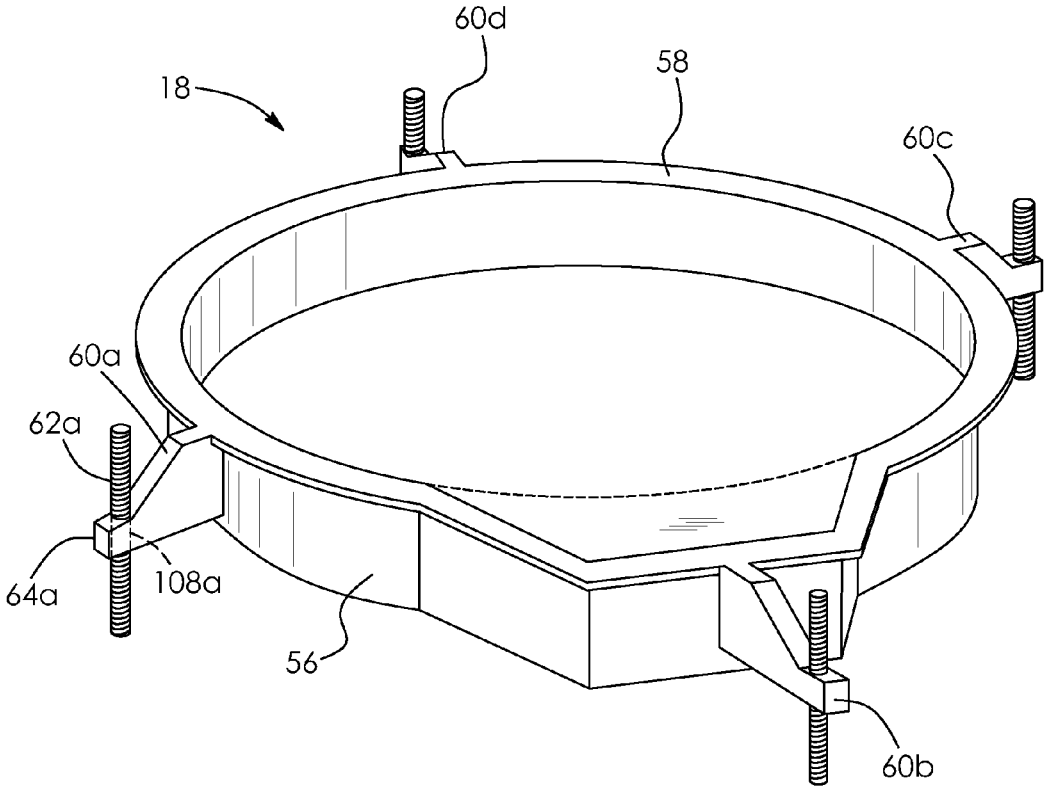
FIG. 10 is a perspective view showing a male support member of the improved support apparatus of FIG. 1.

The male support member 18 is best shown in FIG. 10. The male support member 18 includes four spaced-apart struts 60*a*, 60*b*, 60*c* and 60*d*. In other examples however there may be any number of struts. The struts 60*a*, 60*b*, 60*c* and 60*d* are substantially similar in structure and function. Accordingly, only one of the struts 60*a* is described in detail herein with the understanding that the other struts 60*b*, 60*c* and 60*d* have a substantially similar structure and function in a substantially similar manner. The strut 60*a* is provided with a threaded bore 108*a* at a distal end 64*a* thereof. The set screw 62*a* threadedly extends through the threaded bore 108*a*. In the example of FIG. 10, the struts are integral with and extend radially outward of the side wall 56 however, as shown in FIG. 11, in a second embodiment of the male support member 110 a strut 112 may be removable from the male support member 110.

Figure 11:
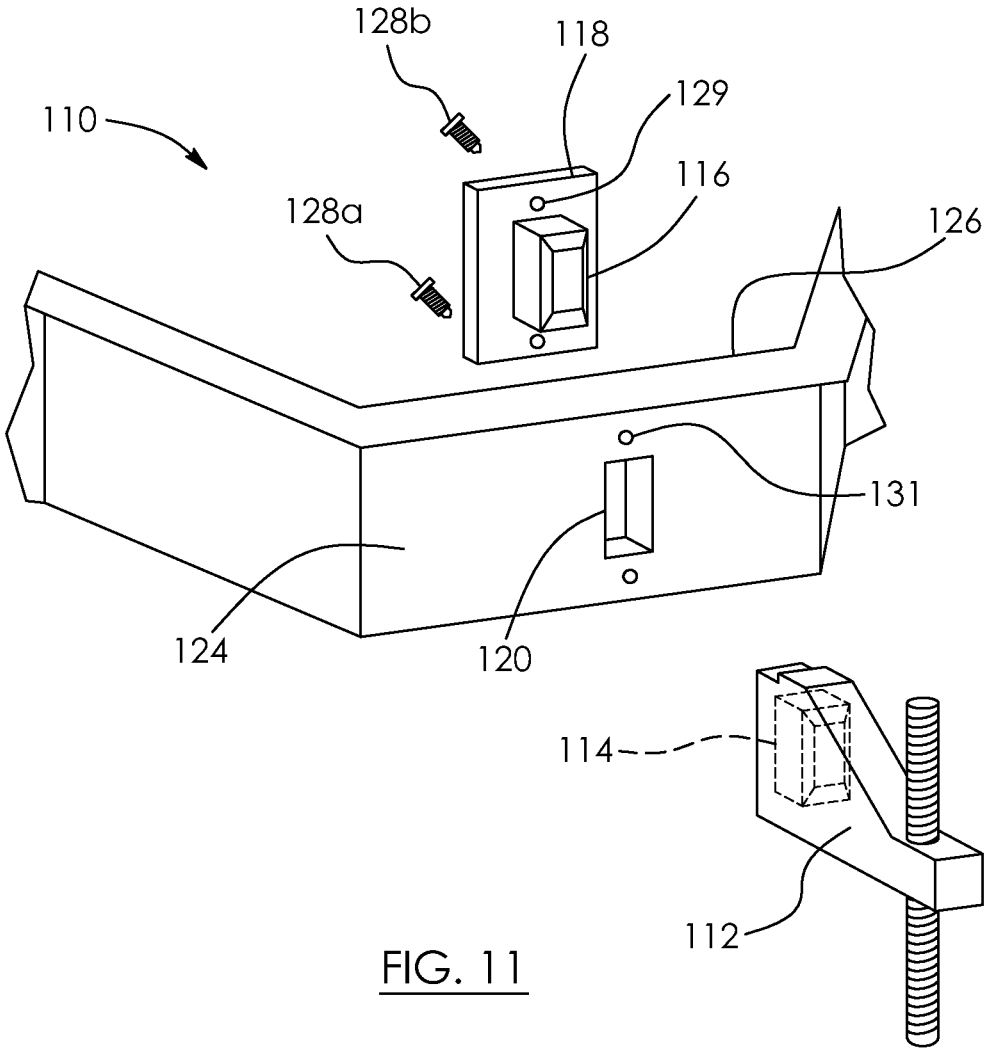
FIG. 11 is disassembled perspective, sectional view showing a second embodiment of a male support member of the improved apparatus of FIG. 1 with the peripheral side wall shown in fragment.
Figure 12:
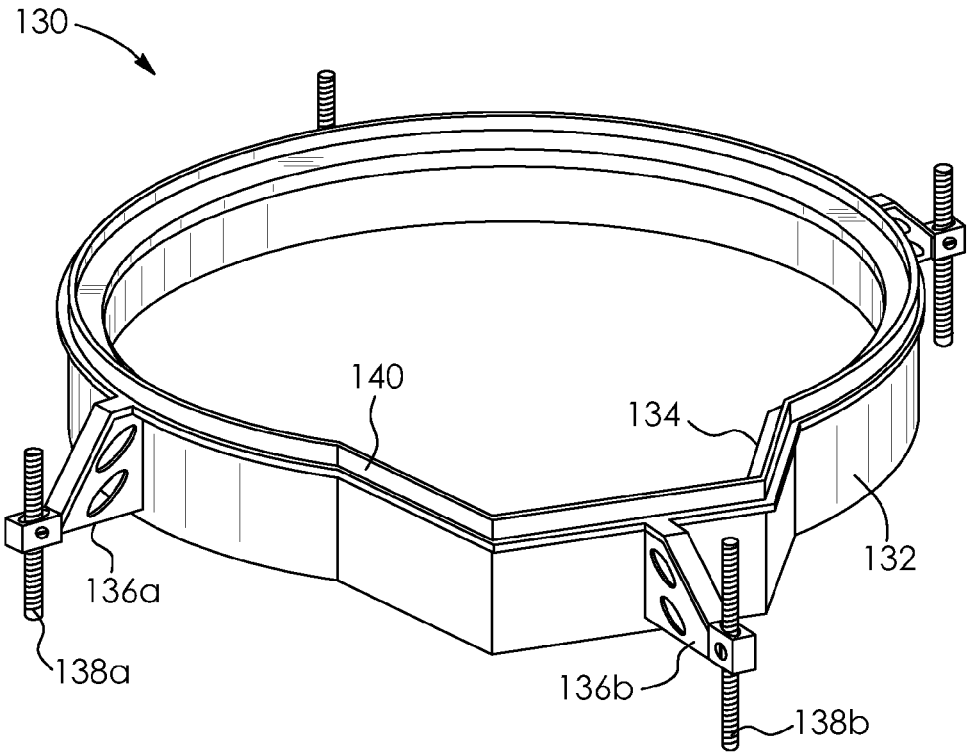
FIG. 12 is perspective view showing a third embodiment of a male support member of the improved support apparatus of FIG. 1.

The strut 112 shown in FIG. 11 is substantially similar to the strut 60*a* shown in FIG. 10 with the notable exception that the strut 112 shown in FIG. 12 is not integrally formed with the male support member 110. Instead the strut 112 is provided with a recess 114 for receiving a protrusion 116 of a mounting plate 118. In this example, the protrusion 116 extends through an aperture 120 in a peripheral side wall 124 of the male support member 110 while the mounting plate 118 is secured to an inner face 126 of the peripheral side wall 124 by fasteners 128*a* and 128*b* which are inserted through apertures 129 and 131. The protrusion frictionally engages the recess 114 in the strut 112, thereby releasably securing the strut 112 at the male support member 110. In other examples, a removable strut may be secured to a male support member through a variety of means including being clipped, snapped or screwed.

Referring now to FIG. 12, a third embodiment of a male support member 130 is shown. The third embodiment of the male support member 130 has a peripheral side wall 132 and a shoulder flange 134 extending along a top edge of the peripheral wall 132. There is a plurality of spaced-apart struts, for example, struts 136*a* and 136*b* extending radially outward from the peripheral side wall 132. The struts are generally triangular in this example. Corresponding threaded set screws 138*a* and 138*b* extend through each of the struts 136*a* and 136*b*. As thus far described the third embodiment of the male support member 130 is generally similar to the embodiment of the male support member 18 shown in FIGS. 1, 2, 3, 6 and 10. However, the third embodiment of the male support member 130 is further provided with a rib 140 extending perpendicularly upward from the shoulder flange 134. The rib 140 extends about the shoulder flange 134 and functions to restrict relative lateral movement of an access cover (similar access cover 12 shown in FIG. 1) when said access cover is seated on the shoulder flange 134. Since the third embodiment of the male support member 130 retains the access cover, the male support member is preferably formed from cast iron.

Figure 13A:
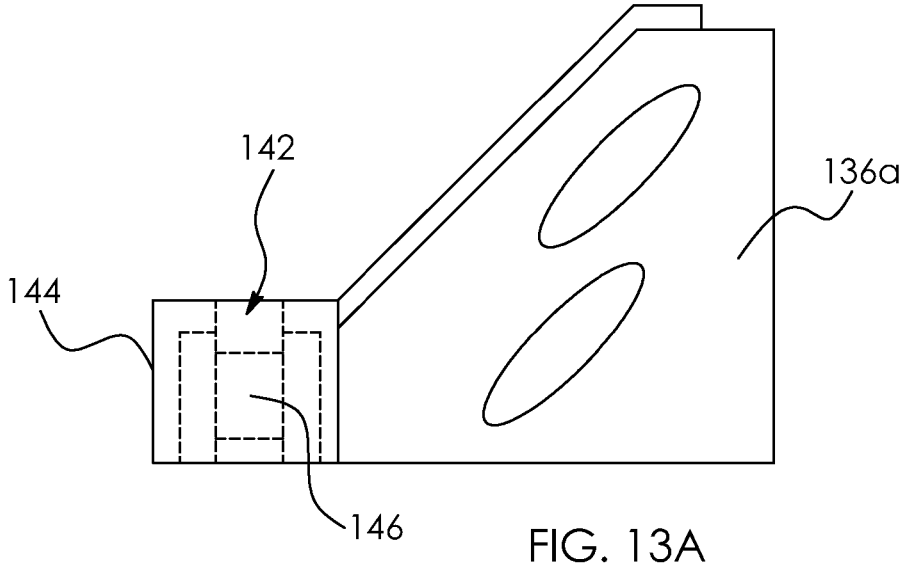
FIG. 13A is an elevation, partially sectional, view showing a strut of the male support member of FIG. 12.
Figure 13B:
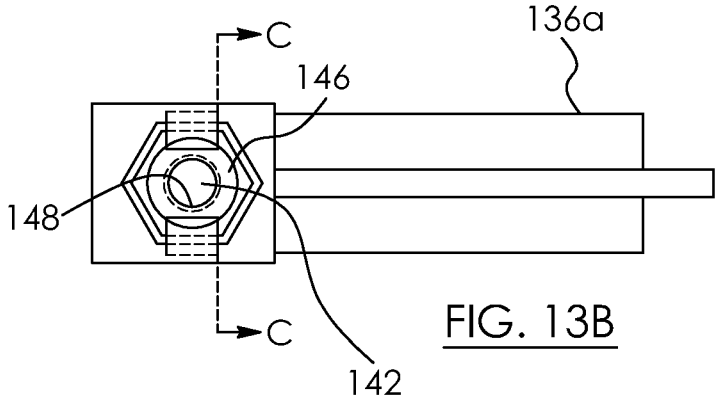
FIG. 13B is a bottom elevation view showing the strut of FIG. 13A.
Figure 13C:
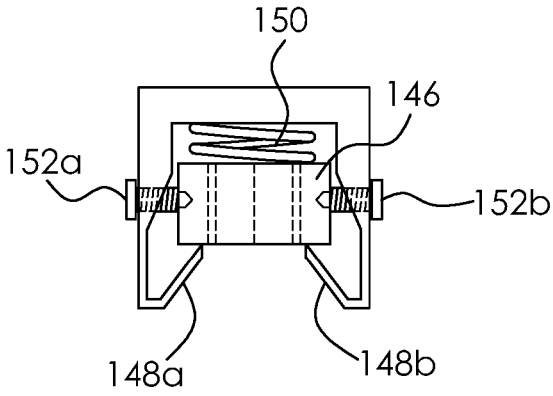
FIG. 13C is a sectional view taken across line C-C of FIG. 13B.

The struts 136*a* and 136*b* of the third embodiment of the male support member 130 are also provided with additional features. One of the struts 136*a* is shown in greater detail in FIGS. 13A to 13C. It will be understood that the others struts of the third embodiment of the male support member 130, shown in FIG. 12, have a substantially similar structure and function in a substantially similar manner. As best shown in FIG. 13A, there is a bore 142 extending through a distal end 144 of the strut 136*a*. However, the bore 142 is not threaded as in the above described examples. Rather there is a threaded cylinder 146 disposed in the bore 142. As best shown in FIG. 13B the threaded cylinder 146 has inner threads 148 which allow the threaded set screw 138*a*, shown in FIG. 12, to be threaded through the bore 142. As best shown in FIG. 13C, the threaded cylinder 146 is retained in place by opposing clasps 148*a* and 148*b* and a retaining spring 150. This allows for movement of the threaded set screw 138*a* within the strut 136*a* to assist in maintaining a vertical plane of the set screw 138*a*. The threaded cylinder 146 may also pivot and is retained by means of screws 152*a* and 152*b* extending through strut 136*a*. Pressure can be increased by tightening the screws 152*a* and 152*b* in order to minimize movement of the threaded cylinder 146.

Figure 14:
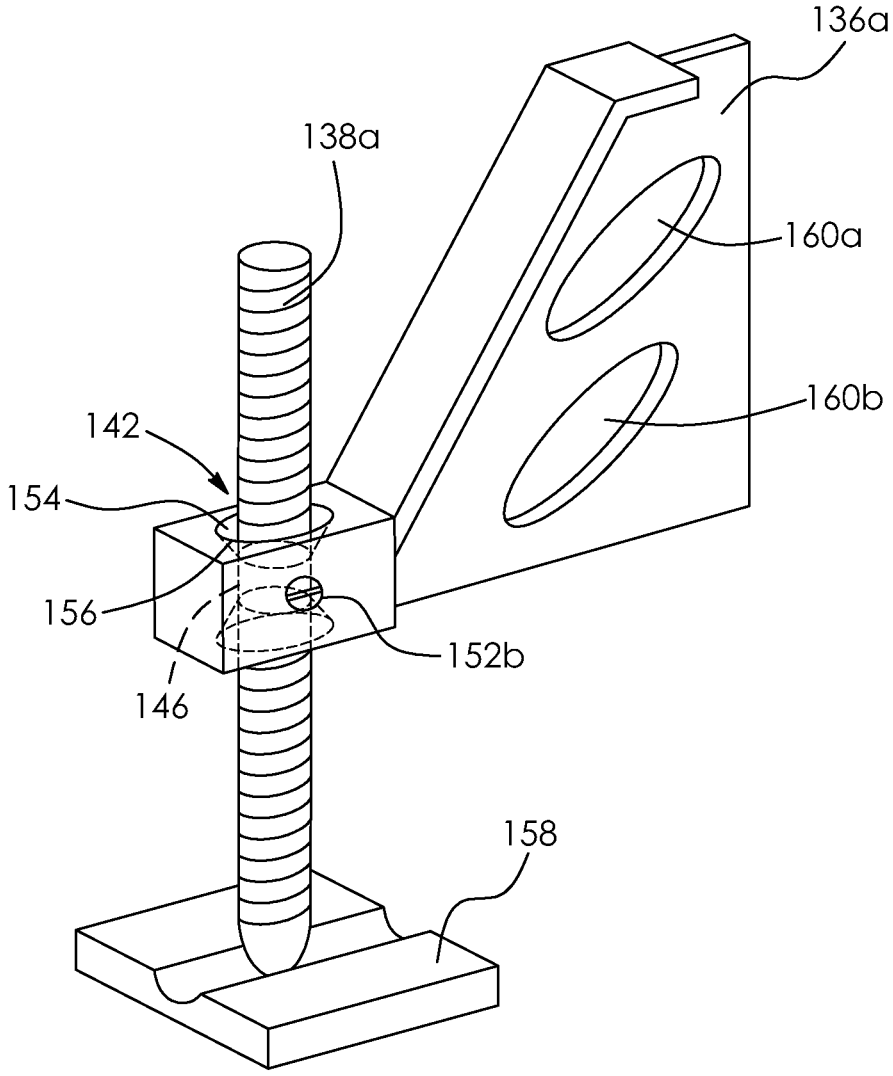
FIG. 14 is an enlarged, perspective view showing a strut of the male support member of FIG. 12.

Referring now to FIG. 14, wall 154 of the bore 142 is sized to snugly retain the threaded cylinder 146 but tapers outwardly towards its ends. This reduces relative lateral movement of the threaded cylinder 146 but allows for movement of the threaded set screw 138*a* while maintaining a vertical place of the set screw 138*a*. The bore 142 has an elliptically shaped mouth 156 to allow for movement of the threaded set screw 138*a*. A channeled support plate 158 may be provided to restrict relative lateral movement while allowing axial movement of the threaded set screws 138*a* during the elevation and gradient adjustments described above. The support plate 158 also disperses loads on surrounding surfaces. The support plate 158 may be free standing, as shown in FIG. 14, or the support plate may be integral with a base flange of a female support member. A lubricant may be applied to the support plate 158.

Figure 15:
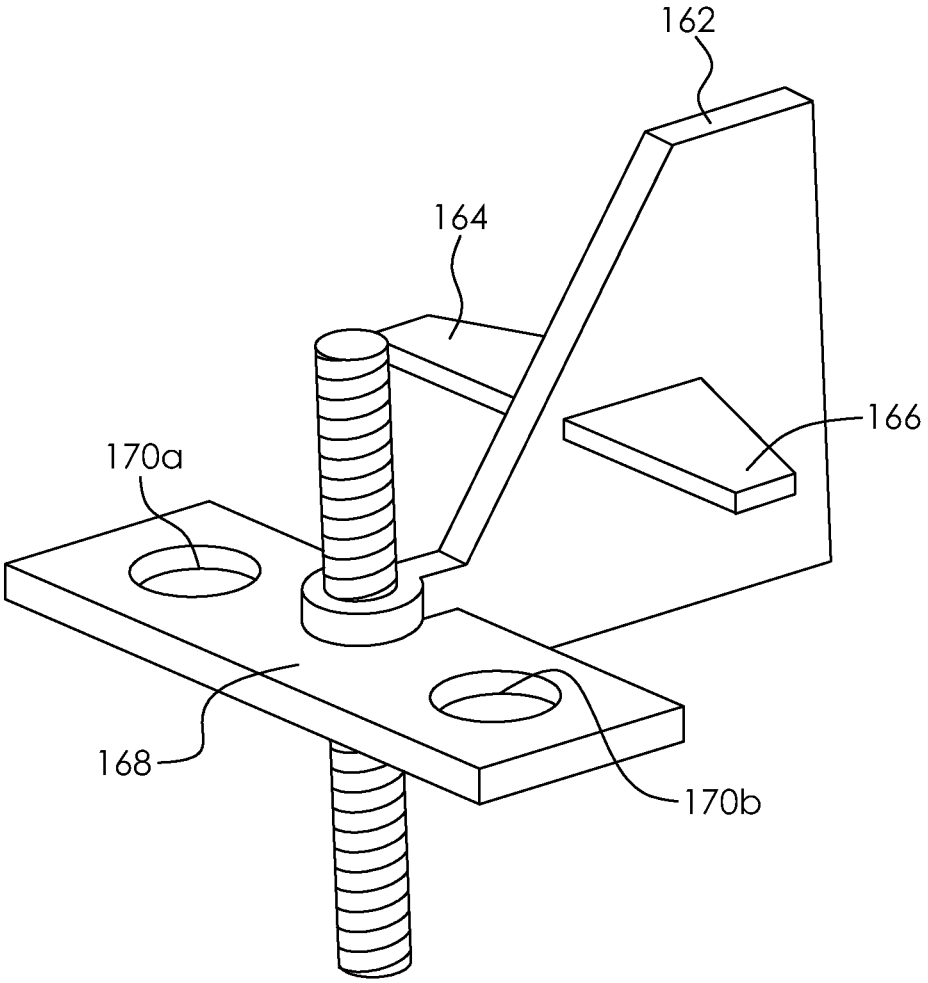
FIG. 15 is a perspective view of another strut which may be provided on the male support member of the improved support apparatus of FIG. 1.

The strut 136*a* is also provided with a pair of lateral openings 160*a* and 160*b* extending therethrough. The openings 160*a* and 160*b* allow the strut 136*a* to be better embedded in a monolithic poured-in-place retaining structure (similar to the retaining structure 28 shown in FIG. 2). This is because the retaining structure can extend through the openings 160*a* and 160*b*. Other means may also be used to better embed a strut in a monolithic poured-in-place retaining structure. For example, an alternative strut 162, shown in FIG. 15, is provided with wings 164, 166 and 168. The wings increase the surface area of the strut 162 to create a more coalescent unit with the retaining structure. The wings may also be provided with openings, for example openings 170*a* and 170*b* shown for wing 168, to allow the retaining structure to extend through the openings 170*a* and 170*b*.

Figure 16A:
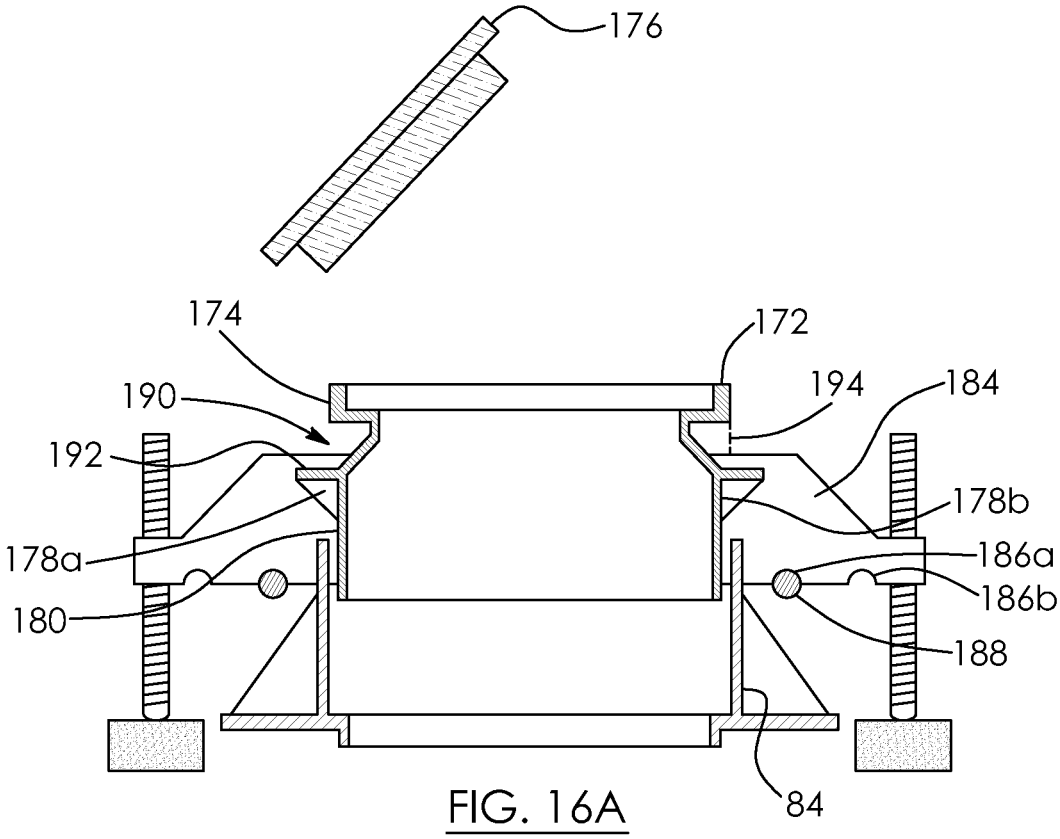
FIG. 16A is an elevation, sectional view showing a fourth embodiment of a male support member of the improved support apparatus of FIG. 1.

Referring now to FIG. 16A, a fourth embodiment of a male support member 172 is shown. The fourth embodiment of the male support member 172 is generally similar to the male support member 18 shown in FIG. 10. However, the fourth embodiment of the male support member 172 further incorporates a frame 174 for an access cover 176 as well as a plurality of circumferentially spaced-apart deflection ribs, for example deflection ribs 178*a* and 178*b*, extending radially outward from a side wall 180 thereof. The deflection ribs 178*a* and 178*b* function to deflect the female support member 84 away from the frame 174 when required and create a more coalescent unit with a monolithic poured-in-place retaining structure (similar to the retaining structure 28 shown in FIG. 2). Struts of the male support member 172, as shown for strut 184, are further provided with recesses 186*a* and 186*b*. The recesses 186*a* and 186*b* allow rings 188 of rebar or wire mesh to be coupled to the strut 184 in order to increase strength. There is also a lateral, annular channel 190 which extends about the male support member 172. The lateral channel extends between the frame 174 and a flange 192 which supports the deflection ribs 178*a* and 178*b*. The channel 190 may be filled during the monolithic pour and this provides additional support to the access cover 176. The male support member 172 may be formed from a variety of materials but is preferably formed from cast iron to best support the access cover 176 and provided with a reinforcing spine 194.

Figure 16B:
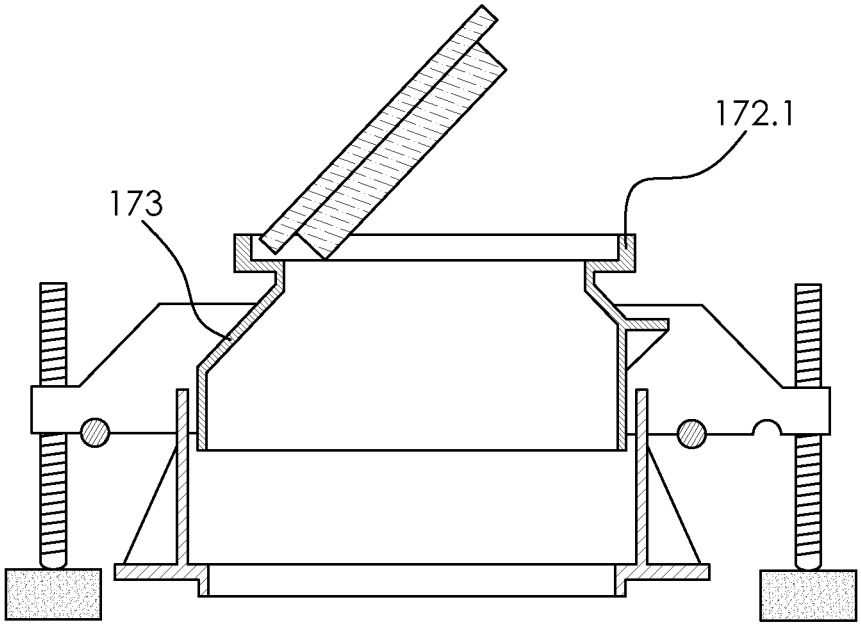
FIG. 16B is an elevation, sectional view showing a fifth embodiment of a male support member of the improved support apparatus of FIG. 1.

A fifth embodiment of the male support member 172.1 is shown in FIG. 16B. The fifth embodiment of the male support member 172.1 shown in FIG. 16B is substantially similar to the fourth embodiment of the male support member 172 shown in FIG. 16A. However, the fifth embodiment of the male support member 172.1 is asymmetrical due to variations in sloped wall 173 about a circumference of the male support member 172.1. This results in the male support member 172.1 being horizontally offset.

Figure 17:
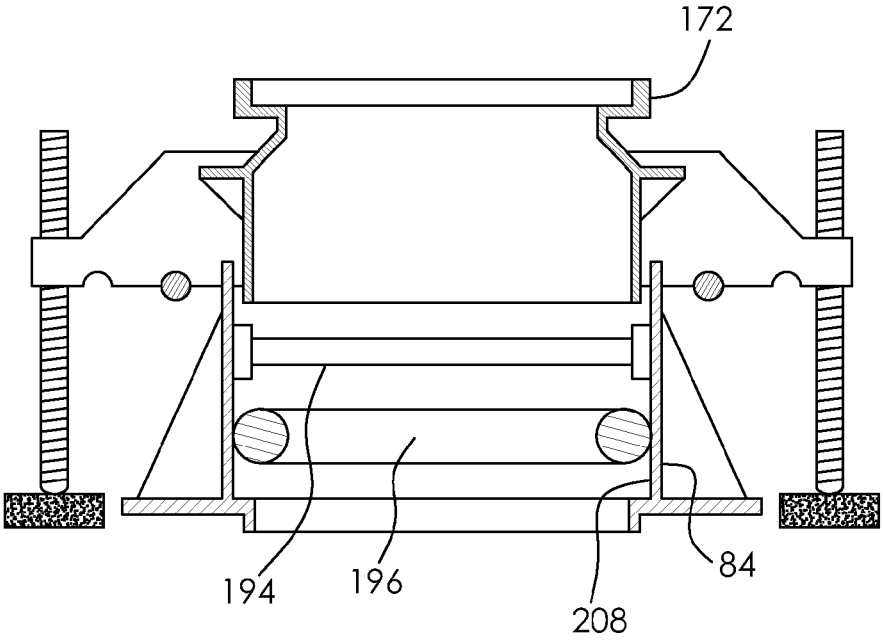
FIG. 17 is an elevation, sectional view showing the fourth embodiment of the of the male support member together with a cross brace for the female support member.
Figure 18:
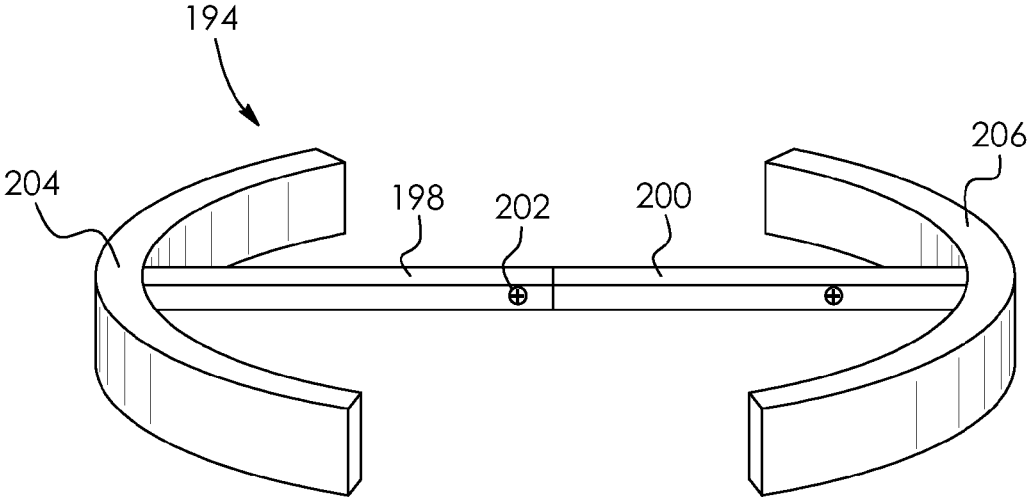
FIG. 18 is a perspective view showing the cross brace of FIG. 17.

As shown in FIG. 17, when the fourth embodiment of the male support member 172 is mated with the female support member 84, the female support member may be provided with a temporary internal brace in the form of a cross brace 194 or an inflatable inner tube 196. The temporary internal brace is particularly useful in situations where a height of the female support member 84 is significant. The cross brace 194 is best shown in FIG. 18. The cross brace 194 includes telescoping shafts 198 and 200 and a pin 202 removably extending through the shafts to allow for relative adjustment of the telescoping shafts. Each of the telescoping shafts 198 and 200 is provided with a respective arched end portion 204 and 206. A curvature of the end portions 204 and 206 generally corresponds to a curvature of an inner wall 208, shown in FIG. 17, of the female support member 84. The telescoping nature of the shafts 198 and 200 allows the brace to be easily placed in and removed from the female support member 84.

Figure 19:
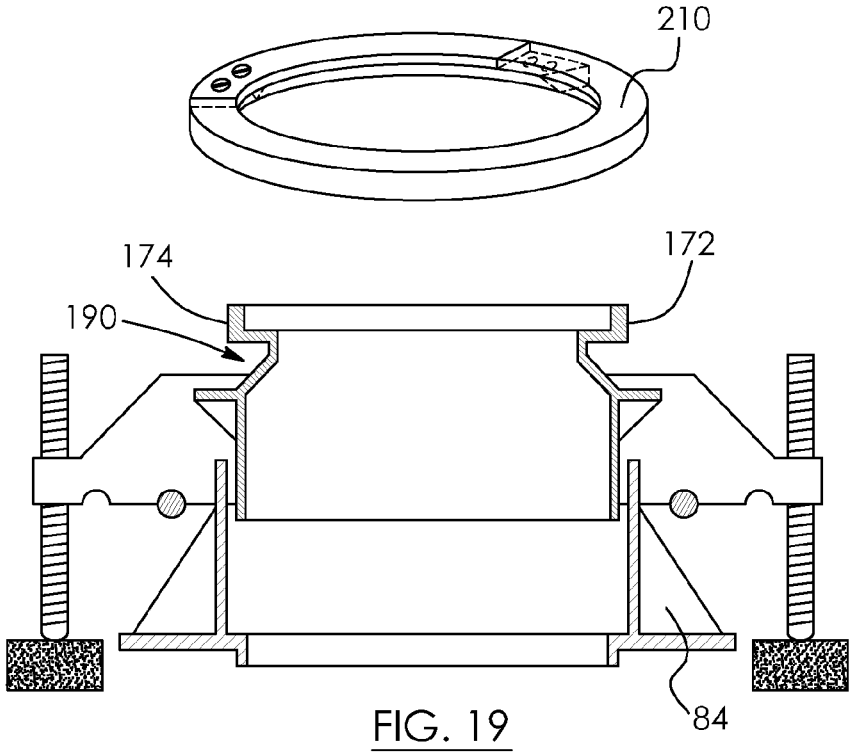
FIG. 19 is an elevation, sectional view showing the fourth embodiment of the male support member together with a split ring, the split ring being removed from the male support member.
Figure 20:
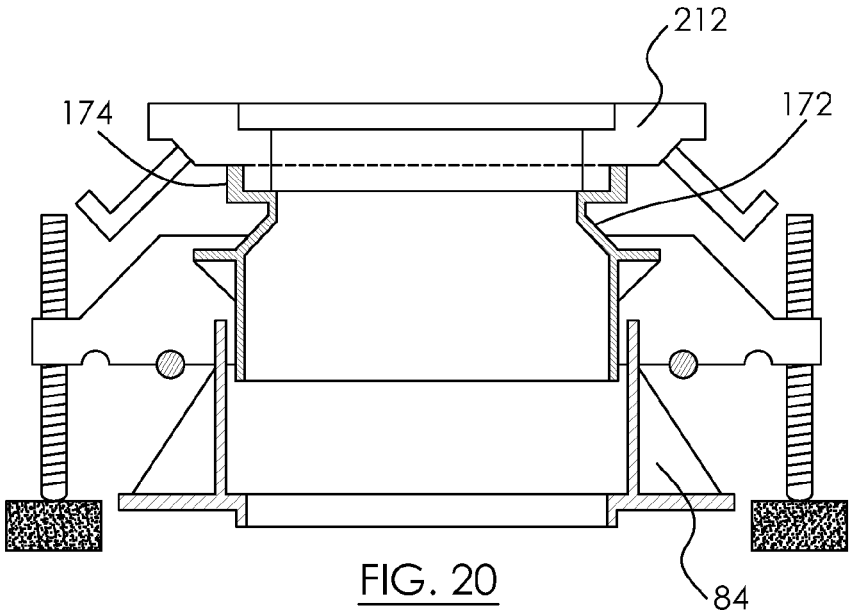
FIG. 20 is an elevation, sectional view showing the fourth embodiment of the of the male support member together with a load ring.

A split ring 210, shown in FIG. 19, may be placed in the lateral channel 190 of the male support member 172 to provide additional support. Alternatively, and as shown in FIG.

20, a cast iron load ring 212 may be set in the frame 174 of the male support member 172. The load ring 212 receives the access cover 176 shown in FIG. 16A. Use of the split ring 210 and load ring 212 are particularly useful if the male support member 172 is formed from a plastic polymer because greater loads may be supported.

In FIGS. 16, 17, 19 and 20 the male support member 172 is mated with the female support member 84 of FIG. 8.

Figure 21:
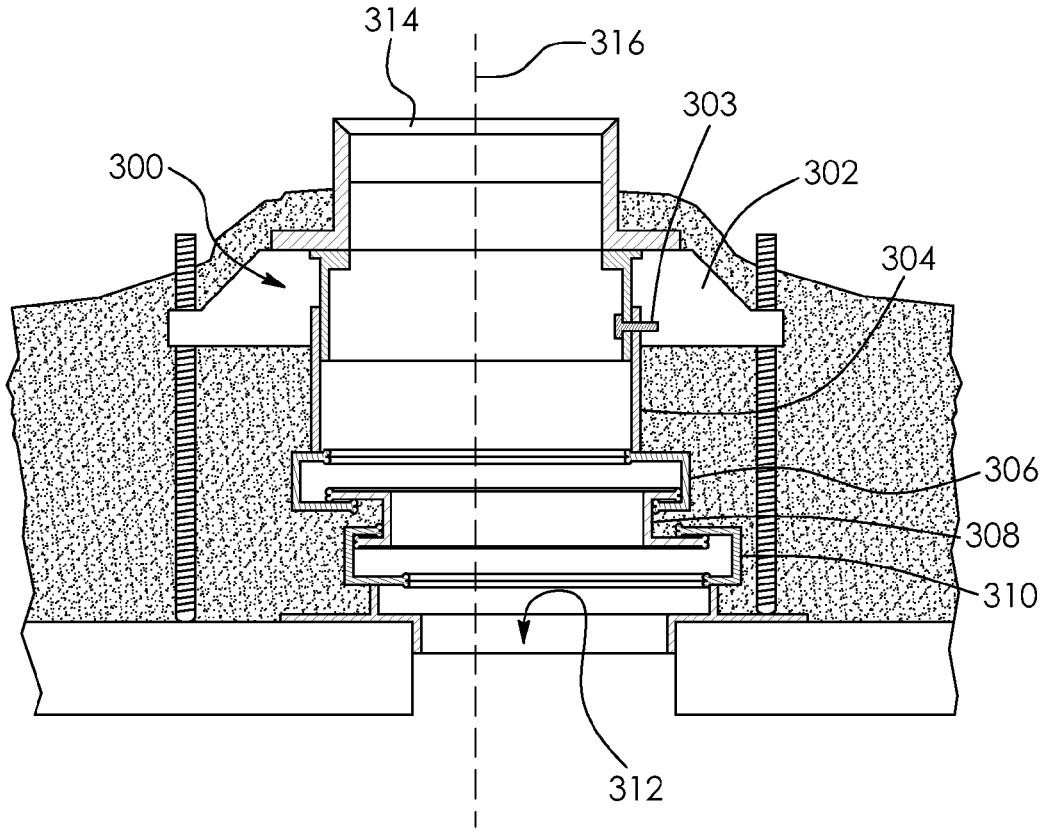
FIG. 21 is an elevation, sectional view showing another embodiment of the improved support apparatus provided with a segmented female support member.

Referring now to FIG. 21, this shows another embodiment of an improved support apparatus 300 for an access cover 314. The support apparatus 300 is configured to sit on an existing opening 312 of a utility and allows the access cover 314 to be horizontally offset from the opening 312 as best illustrated by line 316 in FIG. 21. The male support member 302 of the support apparatus 300 is substantially similar to male support member 18 shown in FIG. 10. The female support member 304 is generally similar to the female support member 20 shown in FIG. 6 but is further provided with a screw 303 securing the male support member 302 to the female support member 304 as well as a plurality of flexible segments 306, 308 and 310 which are designed to allow a horizontal offset.

A first one of the flexible segments 306 is shown in greater detail in FIG. 22. The flexible segment 306 has a generally annular peripheral wall 320 with a pair of offset inwardly projecting flanges 322 and 324 extending from opposite edges of the peripheral wall. A second one of the flexible segments 308 is shown in greater detail in FIG. 23. The flexible segment 308 has a generally annular peripheral wall 330 with a pair of offset outwardly projecting flanges 332 and 334 extending from opposite edges of the peripheral wall. The third one of the flexible segments 310 is has a substantially similar structure to the first flexible segment 306. As best shown in FIG. 24, inward projecting flanges 324 and outward projecting flanges 332 of adjacent flexible segments 306 and 308, respectively, are overlaid with catches 326 and 336, preventing their release. The flanges 324 and 332 are slidable against each other, allowing to peripheral walls 320 and 330 to be offset. Stacking a number of flexible segments in this manner allows for horizontal offset as best shown in FIG. 21.

Figure 26:
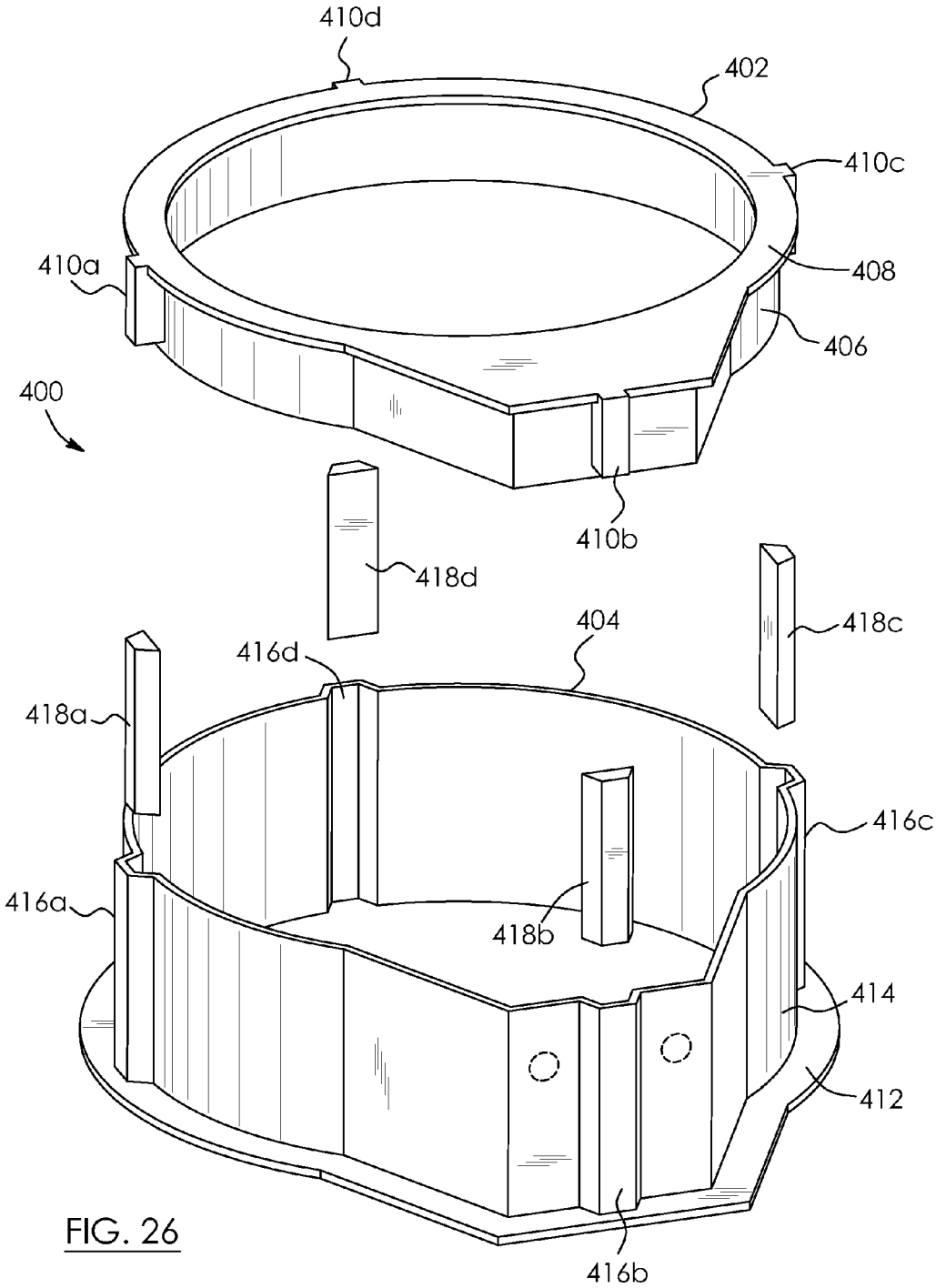
FIG. 26 is an exploded view showing yet another embodiment of an improved support apparatus provide with an inner support member and an outer support member.

Referring now to FIG. 26, this shows yet another embodiment of an improved support apparatus 400 for a frame for a utility access cover (not shown). The support apparatus 400 includes a first support member which, in this example, is an inner support member 402 and a second support member which, in this example, is an outer support member 404. The inner support member 402 has a peripheral side wall 406 and a shoulder flange 408 extending along a top of the side wall 406. There is a plurality of spaced-apart protrusions 410*a*, 410*b*, 410*c* and 410*d*, extending radially outward from the side wall 406. The outer support member 404 has a base flange 412 and a peripheral side wall 414 extending from the base flange. There is a plurality of channels 416*a*, 416*b*, 416*c* and 416*d*, extending axially along the side wall 414 of the outer support member 404. In this example the channels protrude radially of the outer support member 404 but this is not required.

Figure 27A:
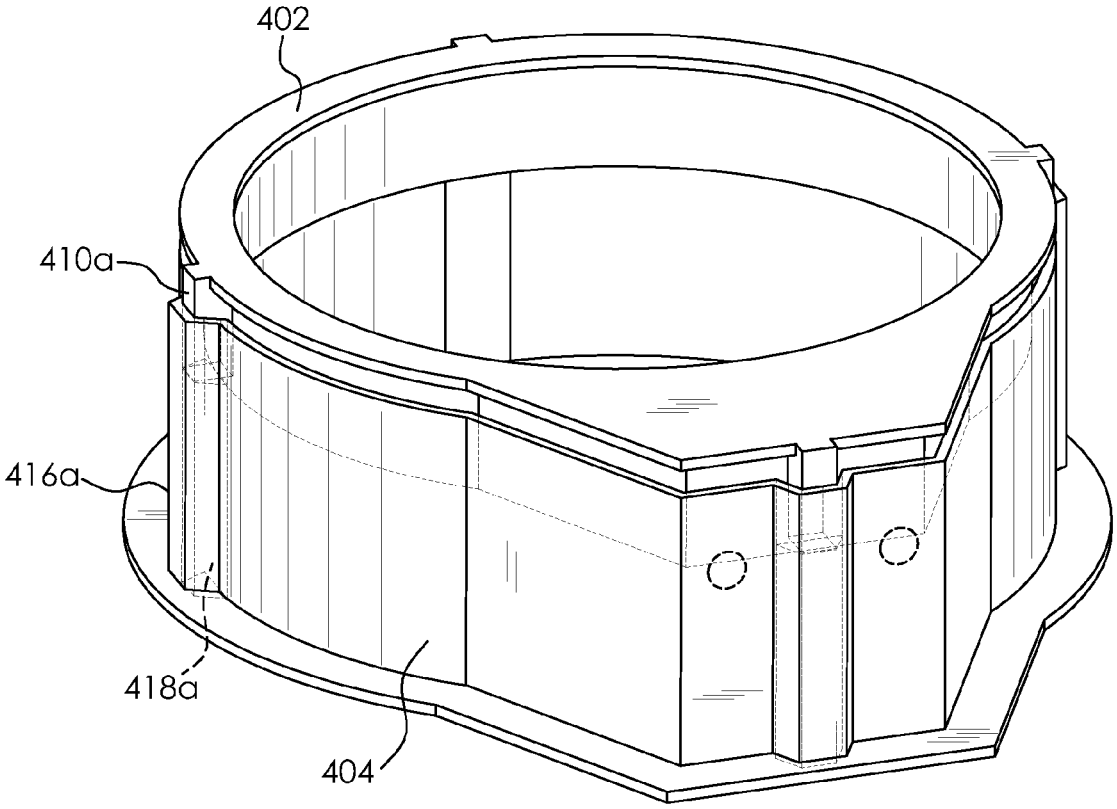
FIG. 27A is a perspective view showing the support apparatus of FIG. 26 showing the support apparatus assembled.
Figure 27B:
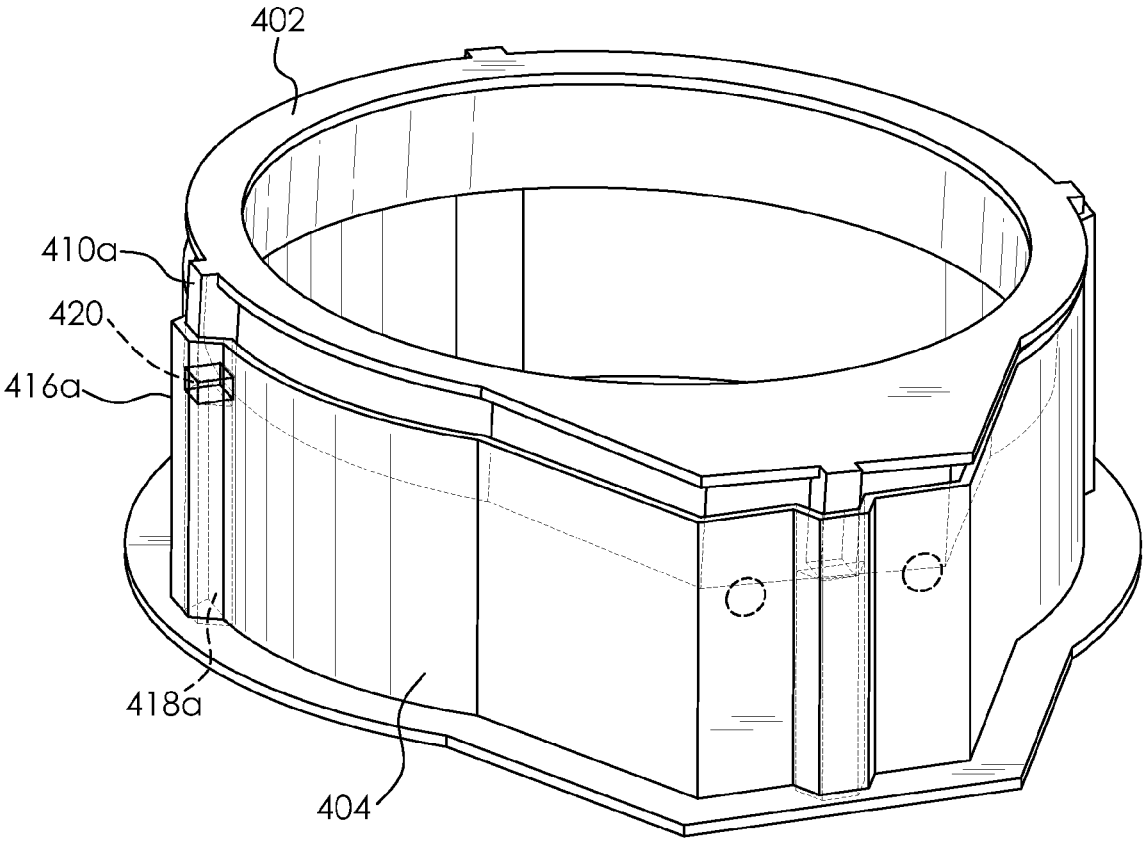
FIG. 27B is another perspective view showing the support apparatus of FIG. 26 provided with a spacer to provide the support apparatus with an inclination.

The support apparatus also includes a plurality of inserts 418*a*, 418*b*, 418*c* and 418*d*. Each of the inserts is received by a corresponding one of the channels as best shown in FIG. 27A for one of the inserts 418*a*. Each of the protrusions of the inner support member is also received by a corresponding channel of the outer support member. This is shown in FIG. 27A for one of the protrusions 410*a* and a corresponding one of the channels 416*a*. Rotation of the mated inner support member 402 and outer support member 404 is thereby prevented as the protrusions are confined to the channels. With reference to FIG. 27B the inclination of the support member may also be adjusted by selectively placing a spacer, for example spacer 420, in the channel 416*a* of the outer support member between corresponding ones of the inserts 418*a* and protrusions 410*a* of the inner support member 402.

Figure 28:
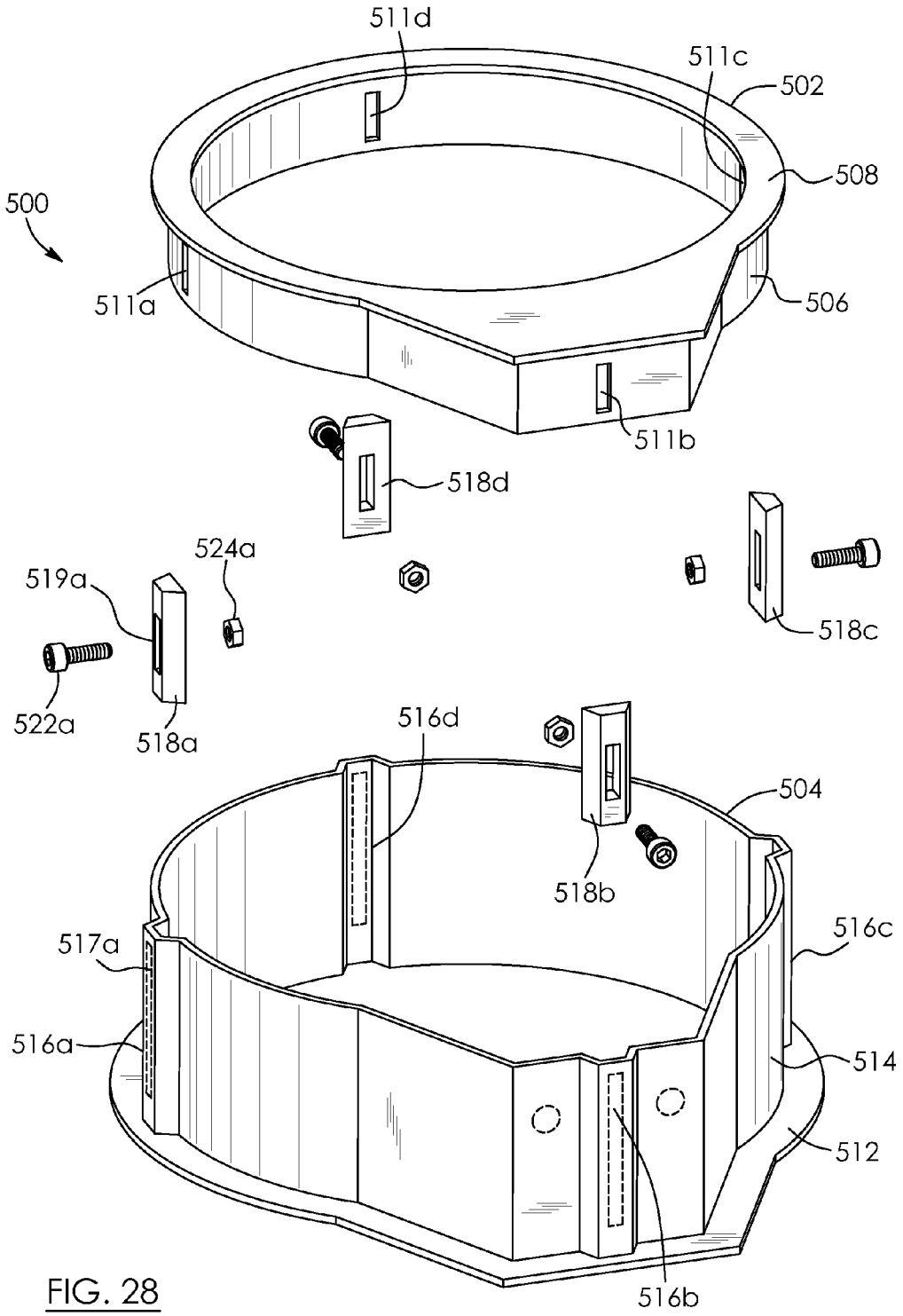
FIG. 28 is an exploded view of yet still another embodiment of an improved support apparatus provided with an inner support member and an outer support member.

Referring now to FIG. 28, this shows yet still another embodiment of an improved support apparatus for a frame for a utility access cover (not shown). The support apparatus 500 includes a first support member which, in this example, is an inner support member 502 and a second support member which, in this example, is an outer support member 504. The inner support member 502 has a peripheral side wall 506 and a shoulder flange 508 extending along a top of the side wall 506. There is a plurality of spaced-apart openings 511*a*, 511*b*, 511*c* and 511*d* on the side wall 506. The outer support member 504 has a base flange 512 and a peripheral side wall 514 extending from the base flange. There is a plurality of channels 516*a*, 516*b*, 516*c* and 516*d*, and extending axially along the side wall 514 of the outer support member 504. Each of the channels is provided with etching for a corresponding knock-out opening, for example knock-out opening 517*a* as shown for one of the channels 516*a* in FIG. 28. In this example, the channels protrude radially of the outer support member 504 but this is not required.

Figure 29A:
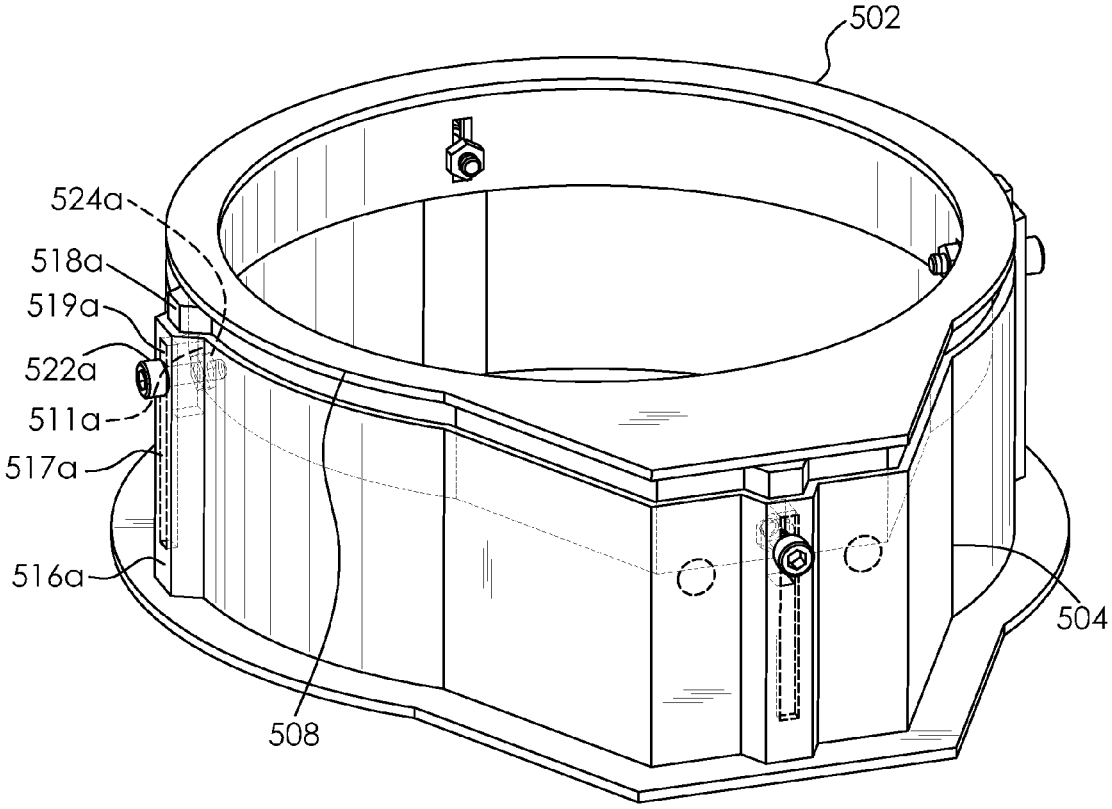
FIG. 29A is a perspective view showing the support apparatus of FIG. 28 showing the support apparatus assembled.

The support apparatus 500 also includes a plurality of inserts 518*a*, 518*b*, 518*c* and 518*d*. Each of the inserts is provided with an opening extending therethrough, for example opening 519*a* shown for insert 518*a* in FIG. 28. Each of the inserts also is received by a corresponding one of the channels as best shown in FIG. 29A for one of the inserts 518*a*. The openings in the side wall of the inner support member are each aligned with a corresponding opening in the side wall of the outer support member. Fasteners, for example bolt 522*a* and 524*a*, secure the inner support member 502 to the outer support member 504. In this example the bolt 522*a* extends through both the opening 511*a* in the inner support member 502 and the opening 517*a* in the outer support member 504 and the bolt is secured in place by the nut 524*a*. The bolt 522*a* also extends through the opening 519*a* in the insert 518*a* and thereby positions the insert 518*a* in the channel 516*a* on the side wall of the outer support member 504.

Figure 29B:
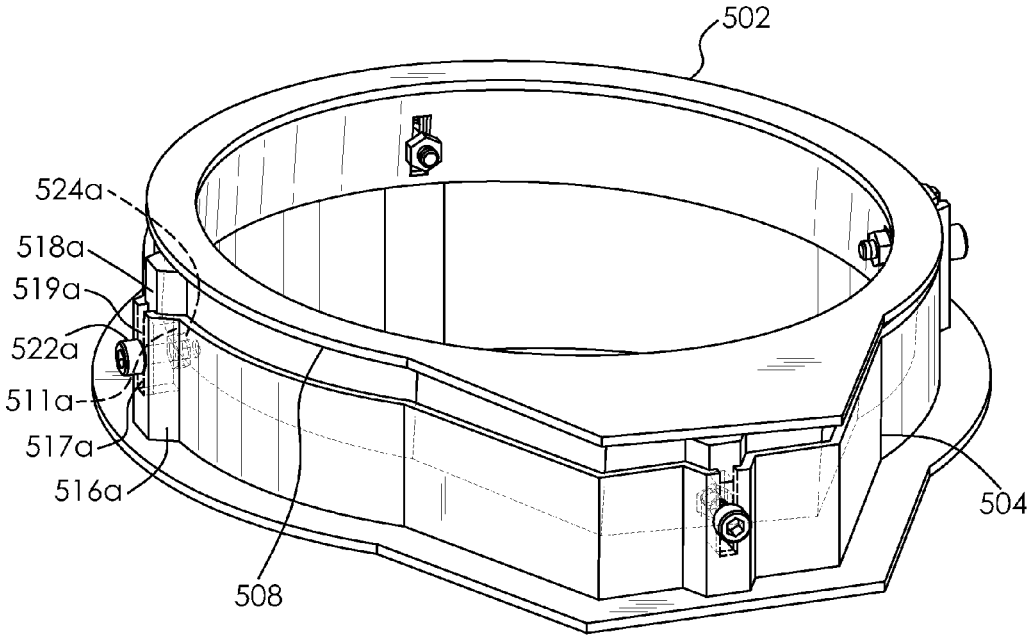
FIG. 29B is another perspective view showing the support apparatus of FIG. 28 with the outer support member cut and the inner support member selectively positioned relative to the outer support member to adjust a height and inclination of the support apparatus.

The shoulder flange 508 of the inner support member 502 is supported by the inserts. Accordingly, the inclination of the support apparatus may be adjusted by selectively positioning the inserts in the channels as best shown in FIG. 29B which shows one of the inserts 518*a* offset as compared to the other inserts. The height of the support apparatus may also be adjusted by cutting the outer support member 504 as shown in FIG. 29B which shows the outer support member 504 cut approximately in half. In this example, the outer support member 504 is formed from a soft material such as plastic to facilitate cutting and the inner support member may be formed from a hard material such as a metal to provide support.

Figure 30:
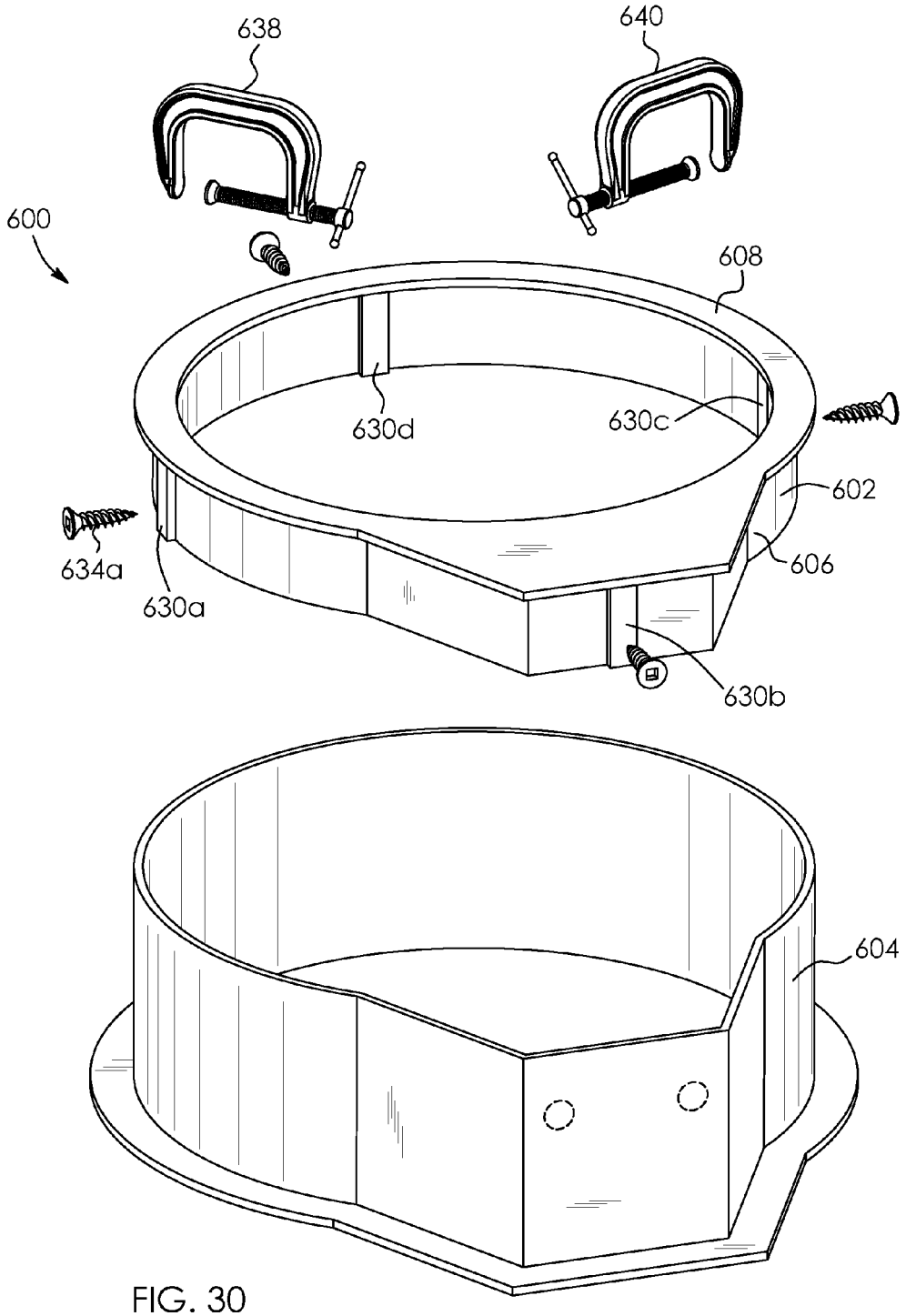
FIG. 30 is an exploded view of still yet another embodiment of an improved support apparatus provided with an inner support member and an outer support member.

Referring now to FIG. 30, this shows still yet another embodiment of an improved support apparatus for an access cover (not shown). The support apparatus 600 includes a first support member which, in this example, is an inner support member 602 and a second support member which, in this example, is an outer support member 604. The inner support member 602 has a peripheral side wall 606 and a shoulder flange 608 extending along a top of the side wall 606. There is a plurality of areas of rigidity 630*a*, 630*b*, 630*c* and 630*d* on the side wall 606. The areas of rigidity may be formed into the inner support member or be added to the inner support member. The support apparatus also includes a plurality of fasteners, for example screw 634*a*, which secure the inner support member 602 to the outer support member 604.

Figure 31:
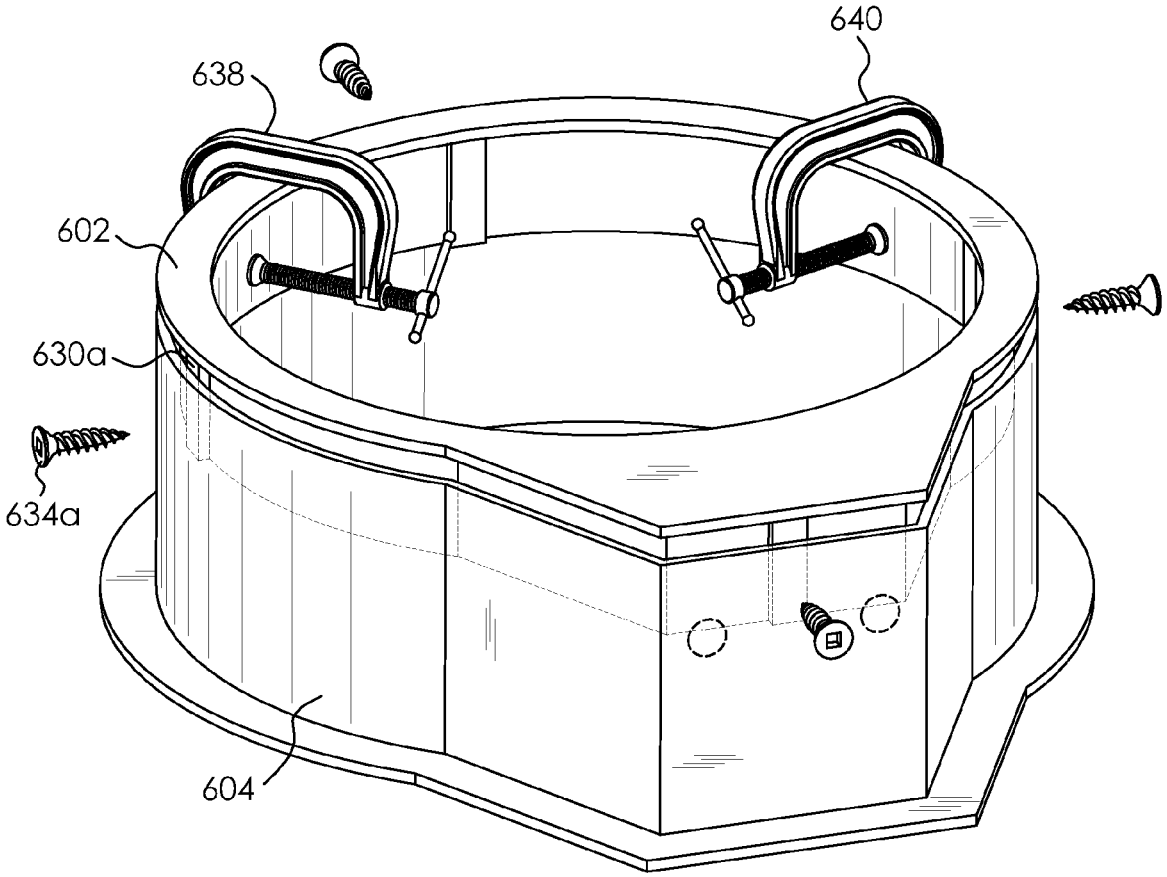
FIG. 31 is a perspective view showing the support apparatus of FIG. 30 partially assembled.
Figure 32:
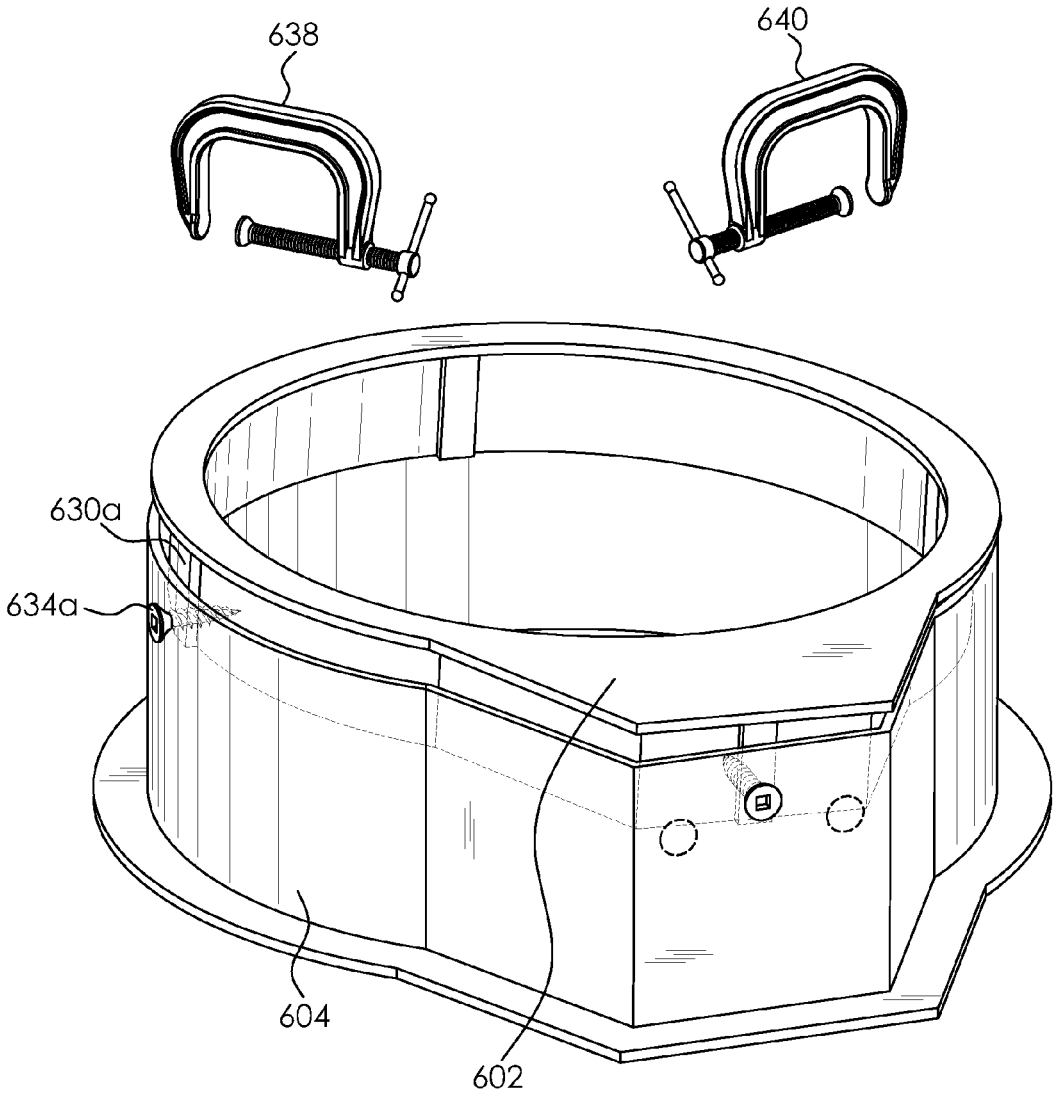
FIG. 32 is another perspective view of the support apparatus of FIG. 30 showing the support apparatus assembled.

To secure the inner support member 602 to the outer support member 604 clamps 638 and 640 may be used to hold the inner support member 602 in position relative to the outer support member 604 as shown in FIG. 31 until the inner support member is secured to the outer support member by the fasteners, for example screw 634*a* as shown in FIG. 32. Accordingly an inclination of the support apparatus may be adjusted by selectively positioning the first support member relative to the second support member and securing the first support member to the second support member with the screws. The screw 634*a* is screwed through the outer support member 604 into the rigid contact area 630*a* of the inner support member 602. This provides support to a plastic outer support member and provides direct load transfer from the inner support member to the outer support member allowing the outer support member to be formed from a flexible material.

Figure 33:
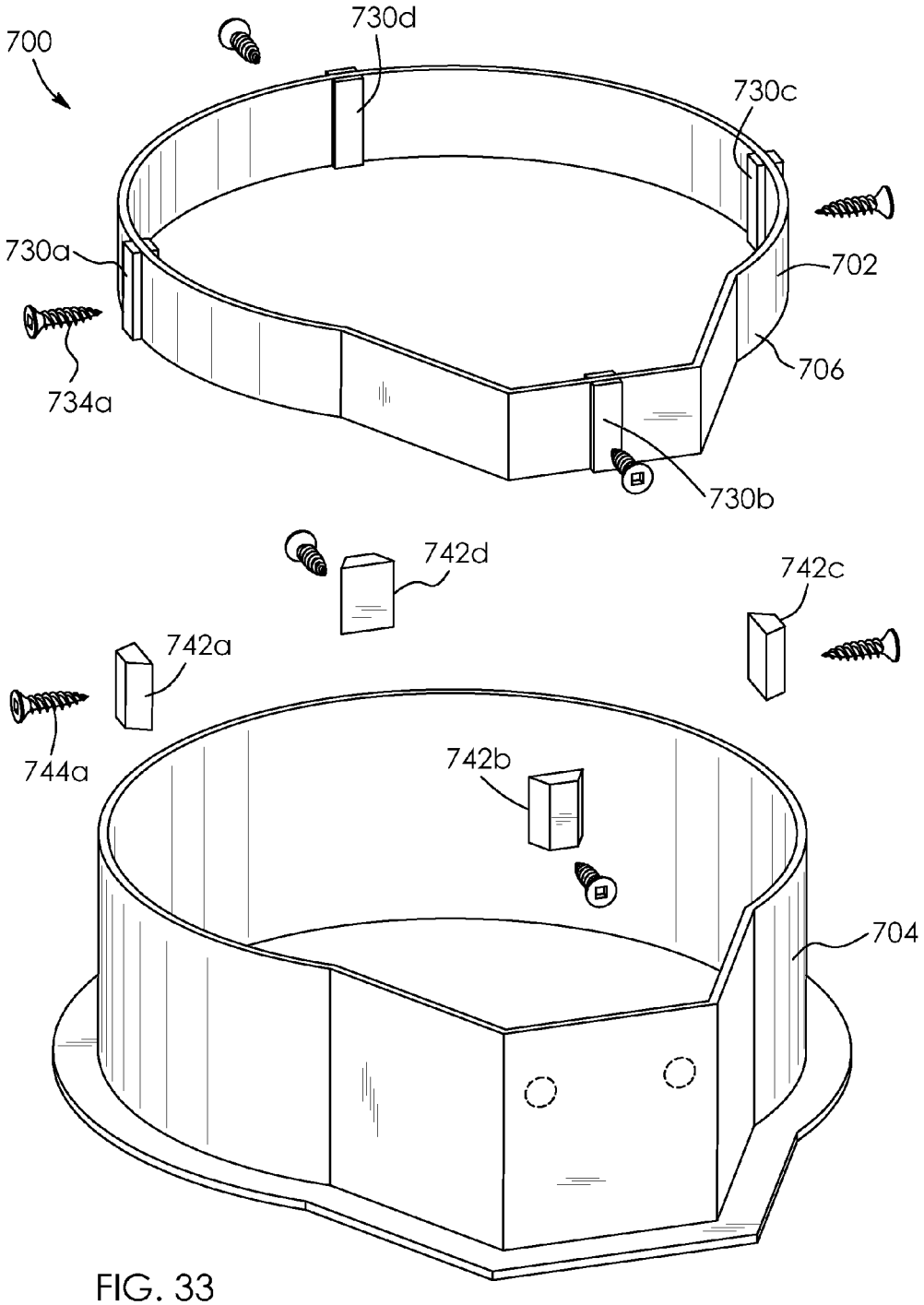
FIG. 33 is an exploded view of still yet another embodiment of an improved support apparatus provided with an inner support member and an outer support member.

Referring now to FIG. 33, this shows still yet another embodiment of an improved support apparatus for an access cover (not shown). The support apparatus 700 includes a first support member which, in this example, is an inner support member 702 and a second support member which, in this example, is an outer support member 704. The inner support member 702 has a peripheral side wall 706. There is a plurality of areas of rigidity 730*a*, 730*b*, 730*c* and 730*d* on the side wall 706. The areas of rigidity may be formed into the inner support member or be added to the inner support member. The support apparatus also includes a plurality of fasteners, for example screw 732*a*, which secure the inner support member 702 to the outer support member 704.

Figure 34:
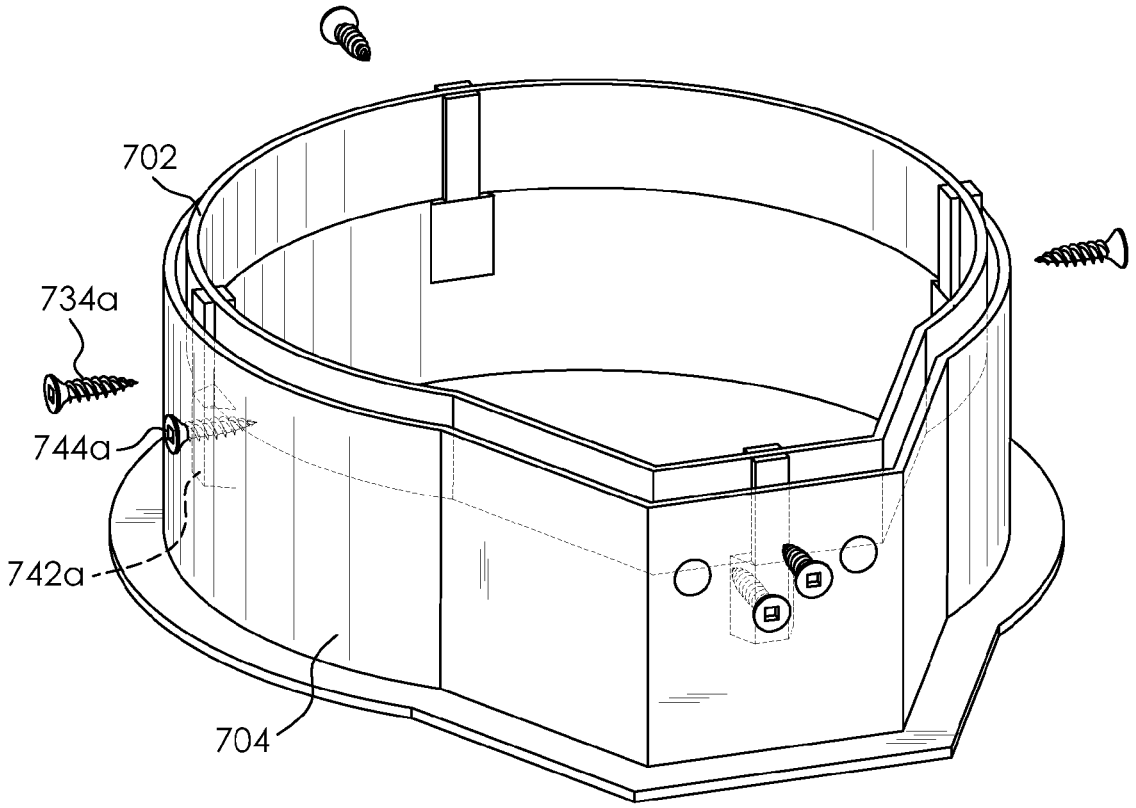
FIG. 34 is a perspective view showing the support apparatus of FIG. 33 partially assembled.
Figure 35:
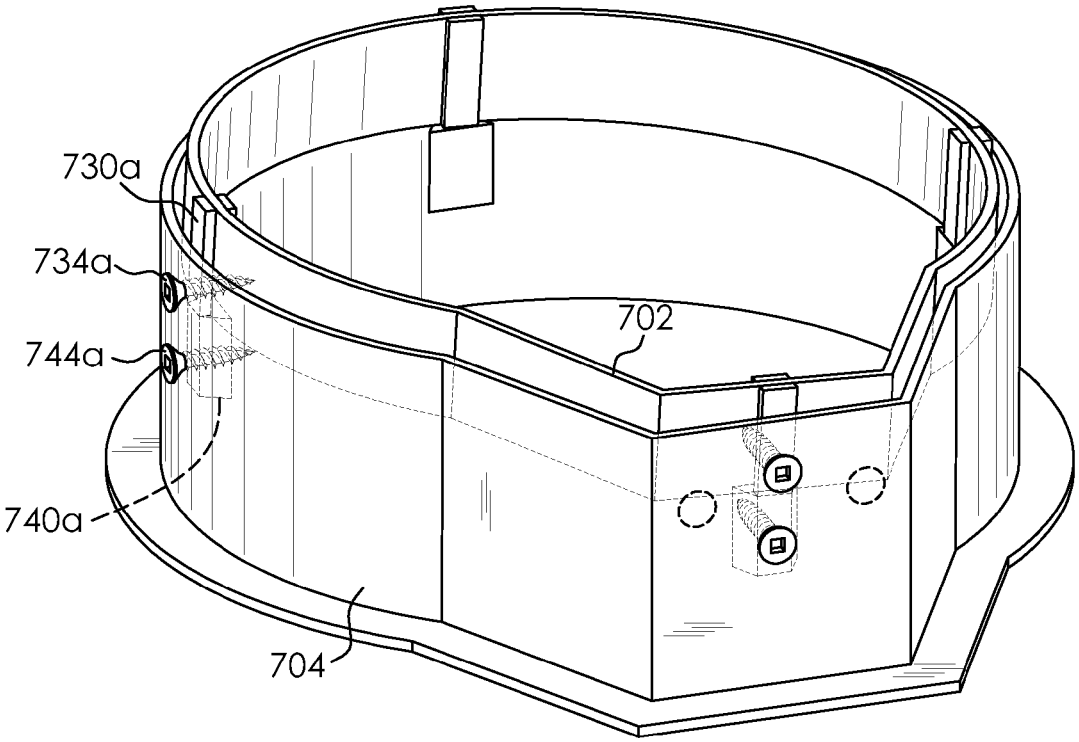
FIG. 35 is another perspective view of the support apparatus of FIG. 33 showing the support apparatus assembled.
Figure 36:
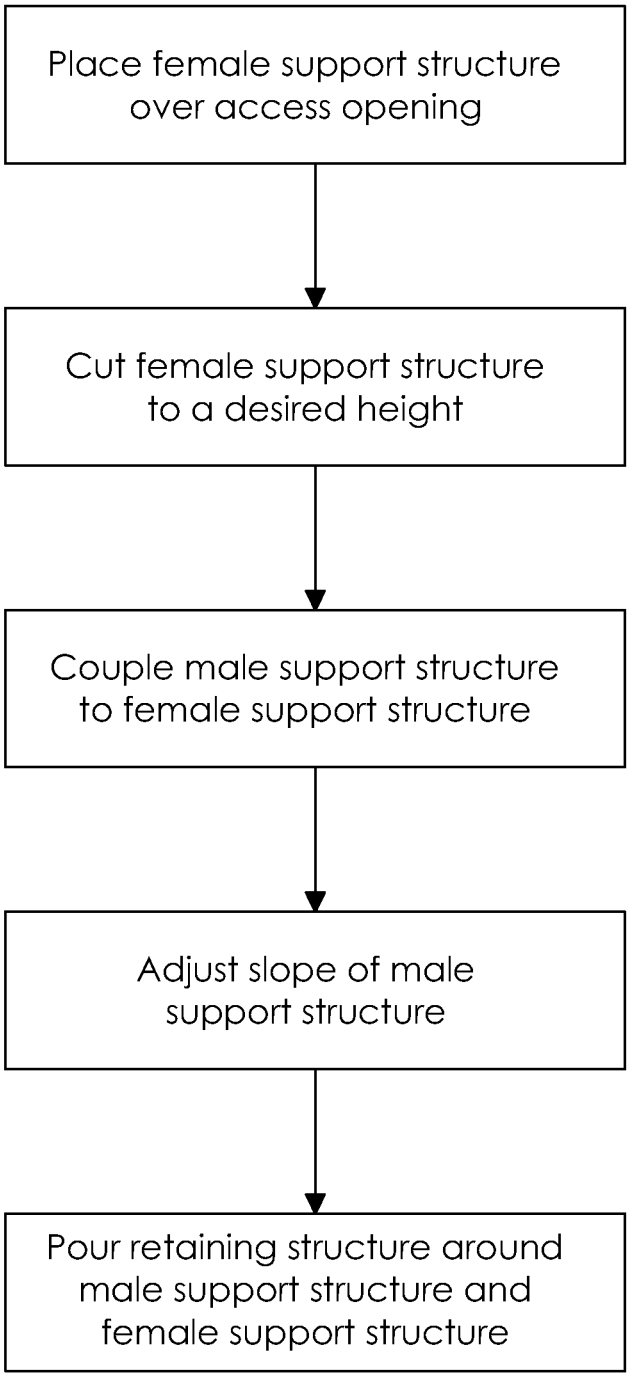
FIG. 36 is a flow chart showing steps for utilizing the support structure of FIGS. 1 to 35.

There is a plurality of inserts 742*a*, 742*b*, 742*c*, and 742*d* which may be secured to the outer support member by fasteners, for example screw 744*a* as shown for one of the inserts 742*a* in FIG. 34 until the inner support member is secured to the outer support member by the fasteners, for example screw 734*a* as shown in FIG. 35. Accordingly an inclination of the support apparatus may be adjusted by selectively securing the inserts 742*a*, 742*b*, 742*c*, and 742*d* to the second support member and securing the first support member to the second support member with the screws. The screw 734*a* is screwed through the outer support member 704 into the rigid contact area 730*a* of the inner support member 702. This provides support.

It will be understood by a person skilled in the art that many of the details provided above are by way of example only, and are not intended to limit the scope of the invention which is to be determined with reference to the following claims.

What is claimed is:

1. A support apparatus for a frame of a utility access cover, the support apparatus comprising:

a first support member and a second support member which is malleable and in telescopic engagement with the first support member, the first support member having a peripheral side wall and the second support member having a peripheral side wall with a plurality of channels extending axially thereon; and a plurality of inserts, each of the inserts being received by a corresponding one of the channels in the side wall of the second support member and the first support member sitting on the inserts, the height and inclination of the support apparatus being adjustable by selectively positioning the inserts in the channels on the side wall of the second support member and the first support member providing the second support member with rigidity required to maintain, a shape of second support member.

2. The support apparatus as claimed in claim 1 further including a plurality of spaced-apart protrusions on the side wall of the first support member, each of the protrusions on the side wall of the first support member being received by a corresponding one of the channels on the side wall of the second support member.

3. The support apparatus as claimed in claim 2 further including a spacer in at least one of the channels in the side wall of the second support member, the spacer being disposed between one of the inserts received by said at least one of the channels in the side wall of the second support member and one of the protrusions on the side wall of the first support member received by said one of the channels in the side wall of the second support member.

4. The support apparatus as claimed in claim 1 further including a plurality of fasteners, each of the fasteners maintaining a corresponding one of the inserts in position in a respective one of the channels in the side wall of the second support member.

5. The support apparatus as claimed in claim 4 further including an opening in each of the channels in the side wall of the second support member and an opening in each of the inserts, each of the fasteners extending through respective corresponding openings in the channels in the side wall of the second support member and the inserts.

6. The support apparatus as claimed in claim 5 further including a plurality of spaced-apart openings in the side wall of the first support member, each of the fasteners further extending through a respective one of the spaced-apart openings in the side wall of the first support member.

7. A method of adjusting a height and inclination of a support apparatus for a frame of a utility access cover, the method comprising:

positioning a malleable support member of the support apparatus about an access opening;

cutting the malleable support member of the support apparatus to a desired height;

engaging another support member of the support apparatus with the cut malleable support member of the support apparatus, said another support member providing the cut malleable support member with rigidity required to maintain a shape of the cut support member;

selectively positioning the said another support member relative to the cut malleable support member; and securing the said another support member to the cut malleable support member.

8. A support apparatus for a frame of a utility access cover, the support apparatus comprising:

a first support member;

a second support member which is malleable and in telescopic engagement with the first support member, the first support member providing the second support member with rigidity required to maintain a shape of the second support member; and a fastener for securing the first support member to the second support member, wherein a height and inclination of the support apparatus is adjustable by trimming the second support member and selectively positioning the first support member relative to the second support member prior to securing the first support member to the second support member with the fastener.

9. The support apparatus as claimed in claim 8 wherein the first support member is metal and the second support member is plastic.

10. The support apparatus as claim in claim 9 wherein the first support member is a male support member and the second support member is a female support member.

* * * * *

UNITED STATES PATENT AND TRADEMARK OFFICE

CERTIFICATE OF CORRECTION

PATENT NO. : 8,858,114 B2
APPLICATION NO. : 13/481504
DATED : October 14, 2014
INVENTOR(S) : Chris Gaspar It is certified that error appears in the above-identified patent and that said Letters Patent is hereby corrected as shown below:

In the Claims

In claim 1 replace “maintain, a shape” at column 15, line 67, with “maintain a shape”.

In claim 1 replace “shape of second support member” at column 15, line 67, with “shape of the second support member”.

Signed and Sealed this
Twenty-fourth Day of February, 2015

Michelle K. Lee

Michelle K. Lee
*Deputy Director of the United States Patent and Trademark Office*